US011122898B2

(12) United States Patent
Kiwak et al.

(10) Patent No.: US 11,122,898 B2
(45) Date of Patent: Sep. 21, 2021

(54) RECLINER OR LIFT AND RECLINER CHAIR WITH VARIABLE LIFT PROFILE

(71) Applicant: Golden Technologies, Inc., Old Forge, PA (US)

(72) Inventors: Frederick J. Kiwak, Harding, PA (US); James Olcheski, Duryea, PA (US); James M. Kosco, West Wyoming, PA (US); W. Edward Pollard, Falls, PA (US)

(73) Assignee: GOLDEN TECHNOLOGIES, INC., Old Forge, PA (US)

( * ) Notice: Subject to any disclaimer, the term of this patent is extended or adjusted under 35 U.S.C. 154(b) by 0 days.

(21) Appl. No.: 17/079,683

(22) Filed: Oct. 26, 2020

(65) Prior Publication Data

US 2021/0037976 A1 Feb. 11, 2021

Related U.S. Application Data

(63) Continuation of application No. 16/410,222, filed on May 13, 2019, now Pat. No. 10,813,457, which is a (Continued)

(51) Int. Cl.
*A47C 7/50* (2006.01)
*A47C 1/024* (2006.01)
(Continued)

(52) U.S. Cl.
CPC ..... *A47C 1/0242* (2013.01); *A47C 1/0352* (2013.01); *A47C 1/0355* (2013.01);
(Continued)

(58) Field of Classification Search
CPC ..... A47C 5/06; A47C 1/0342; A47C 7/40; A47C 1/024; A47C 1/03211; A47C 1/03294; A61G 5/1067; A61G 5/1091
See application file for complete search history.

(56) References Cited

U.S. PATENT DOCUMENTS 4,007,960 A 2/1977 Gaffney
4,852,939 A 8/1989 Krauska
(Continued)

FOREIGN PATENT DOCUMENTS

CN 104720397 6/2015
DE 19944114 4/2001

*Primary Examiner* — Shin H Kim
(74) *Attorney, Agent, or Firm* — Volpe Koenig

(57) ABSTRACT

A recliner or lift and recliner chair is provided having a recline or lift and recline chair mechanism with preferably with at least one recline or lift-recline actuator that controls a reclining movement or a lifting and reclining movement. The chair mechanism has a recline or lift-recline base, a seat and a back connected thereto. For additional functionality, a cradle assembly is provided in order to provide a cradling movement to the recline or lift-recline base. The cradle assembly can be provided by a system of standoffs and pivot connections, which can be direct or use links, or can be configured with a track and roller or slide system in order to achieve a desired cradling movement. A cradle actuator is connected between the cradle base and the recline or lift-recline base. A controller is provided that controls movement of the cradle actuator and preferably at least one recline or lift-recline actuator.

21 Claims, 32 Drawing Sheets

Related U.S. Application Data continuation of application No. 15/892,840, filed on Feb. 9, 2018, now Pat. No. 10,327,553.

(60) Provisional application No. 62/457,259, filed on Feb. 10, 2017.

(51) Int. Cl.

| | |
|---|---|
| ***A61G 5/14*** | (2006.01) |
| ***A47C 3/20*** | (2006.01) |
| ***A47C 31/00*** | (2006.01) |
| ***A47C 1/035*** | (2006.01) |
| ***A47C 1/032*** | (2006.01) |
| ***A47C 1/0355*** | (2013.01) |

(52) U.S. Cl.

CPC ..... *A47C 1/03211* (2013.01); *A47C 3/20* (2013.01); *A47C 7/506* (2013.01); *A47C 31/008* (2013.01); *A61G 5/14* (2013.01); *A61G 2203/12* (2013.01)

(56) References Cited

U.S. PATENT DOCUMENTS

| | | | | |
|---|---|---|---|---|
| 5,072,988 | A | 12/1991 | Plunk | |
| 5,312,153 | A | 5/1994 | Lin | |
| 5,765,913 | A | 6/1998 | LaPointe et al. | |
| 6,213,554 | B1 | 4/2001 | Marcoux et al. | |
| 6,604,791 | B1 | 8/2003 | Chen | |
| 7,090,297 | B2 | 8/2006 | Mohn et al. | |
| 7,445,279 | B2 | 11/2008 | Crum | |
| 7,455,360 | B2 | 11/2008 | White et al. | |
| 7,543,885 | B2 | 6/2009 | Pollard et al. | |
| 7,600,817 | B2 | 10/2009 | Kramer et al. | |
| 7,766,421 | B2 | 8/2010 | Lawson | |
| 8,308,228 | B2 | 11/2012 | Lawson et al. | |
| 8,727,433 | B2 | 5/2014 | Lawson | |
| 8,915,544 | B2 | 12/2014 | LaPointe | |
| 9,010,851 | B2 | 4/2015 | LaPointe | |
| 9,016,788 | B1 | 4/2015 | Pollard et al. | |
| 9,227,729 | B2 | 1/2016 | Udriste et al. | |
| 9,326,606 | B2 | 5/2016 | LaPointe | |
| 9,332,844 | B2 | 5/2016 | Regev | |
| 9,795,528 | B1 | 10/2017 | Delmestri et al. | |
| 2001/0035668 | A1* | 11/2001 | Gaffney ..... | A47C 1/0345 297/85 M |
| 2001/0035688 | A1 | 11/2001 | Gafney et al. | |
| 2011/0181094 | A1 | 7/2011 | Lawson et al. | |
| 2012/0193946 | A1 | 8/2012 | Robertson | |
| 2013/0175847 | A1 | 7/2013 | Lawson | |
| 2015/0076881 | A1 | 3/2015 | LaPointe | |
| 2016/0045031 | A1 | 2/2016 | Lawson | |
| 2016/0058191 | A1 | 3/2016 | Hegedus et al. | |
| 2016/0100686 | A1 | 4/2016 | Regev | |
| 2016/0100687 | A1 | 4/2016 | Murphy et al. | |
| 2016/0144964 | A1 | 5/2016 | Braca et al. | |

* cited by examiner

RECLINER OR LIFT AND RECLINER CHAIR WITH VARIABLE LIFT PROFILE

INCORPORATION BY REFERENCE

The following documents are incorporated herein by reference as if fully set forth: U.S. patent application Ser. No. 16/410,222, filed May 13, 2019; U.S. patent application Ser. No. 15/892,840, filed Sep. 9, 2018; and U.S. Provisional Application No. 62/457,259, filed Feb. 10, 2017.

FIELD OF INVENTION

The invention relates to chairs in general, and more particularly to recliner chairs and lift chairs.

BACKGROUND

Recliner chairs and lift chairs have been on the market for years, with the utility of recliners being primarily for use in living rooms and family rooms, while lift chairs are used by the handicapped, elderly, or disabled to assist them in moving from a reclined or sitting position to a standing position. While a substantial number of today's recliners are still manually operated, a growing number of recliners, and almost all lift chairs, utilize one or more actuators to move the footrest, back frame, and seat frame into various positions with respect to each other including reclining positions within a specified range, as well as to physically lift the chair while tipping it forward to aid the occupant to stand up. In one known chair type, independent movement of the footrest and backrest is accomplished through the use of separate actuators, while other chairs utilize a single interconnected actuator to cause the footrest and backrest to move together or simultaneously.

In addition to the usual television watching and other relaxing positions, a few known chairs can also be moved or pivoted into certain special positions. One of these is the so-called Trendelenburg position, wherein the occupant's legs are situated so that they are higher in relation to the ground than the heart. This position is useful particularly for those having certain circulatory, kidney, or other ailments, since in such position gravity assists the flow of blood from the legs back to the heart. Another special position is the so-called "zero gravity" or 90/90 position. To achieve such position, the chair is moved so that the head and torso are at a slight upward angle, the legs up to the knee are bent at a similar opposite upward angle, and the knees are bent so that the lower area of the legs is angled similarly to the torso. The zero-gravity position approximates the position or posture that astronauts assume when sleeping in a weightless environment. The primary benefit of such position is reduced pressure on the spine, which often relieves back pain at least to some extent.

One known lift and recline mechanisms developed by the assignee of the present invention that addresses some of the issues with respect to positioning the back frame relative to the seat frame is described in U.S. Pat. No. 9,016,788, which is incorporated herein by reference as if fully set forth. Other known lift and recline mechanisms use one or two actuators are also known from U.S. Pat. No. 8,308,228 and U.S. Patent Application Publication 2001/0035668

One specific issue that is not addressed by these known lift and recline mechanisms is that extra lift may be required for certain users, as well as that further positions that provide comfort to a user in the reclined position may be desirable, but are limited by the specific travel path of the lift and recline mechanism.

SUMMARY

Briefly stated, in one arrangement a lift and recliner chair is provided having a lift and recline chair mechanism with at least one lift-recline actuator that controls a lifting movement and a reclining movement. The lift and recline chair mechanism has a lift-recline base, a seat and a back connected to the lift and recline chair mechanism, with the back being effectively pivotable relative to the seat. For additional functionality, a cradle assembly is provided including a cradle base, with rear standoffs on the cradle base with aligned rear pivot axes, and front standoffs on the cradle base with aligned front pivot axes. The front pivot axes are located above the rear pivot axes, preferably by a distance H of at least about 3 inches. An actuator mount is connected to the cradle base. Front links having first ends are pivotably connected to respective ones of the front standoffs at the front pivot axes and second ends pivotably connected to respective ones of front pivot connections on the lift-recline base. Rear links having first ends are pivotably connected to respective ones of the rear standoffs at the rear pivot axes and second ends pivotably connected to respective ones of rear pivot connections on the lift-recline base. A cradle actuator is connected between the actuator mount and the lift-recline base. The cradle actuator is adapted to move the lift-recline base from a start position in a forward direction to a cradle position. A controller is provided that controls movement of the cradle actuator and the at least one the lift-recline actuator.

In one arrangement, the controller is configured to actuate the cradle actuator to move the lift-recline base forward and preferably also tilt it upwards as the at least one lift-recline actuator is actuated to recline the back to at least partially offset an extension distance of the back from the cradle base.

In one arrangement, the front links are arranged angled forward by at least 20° in the start position. This results in a reduced forward translation in connection with the lift of the cradling motion.

In one arrangement, the lift-recline base includes rear uprights and the rear pivot connections are located on the rear uprights. Preferably, the rear pivot connections on the rear uprights are located at least 3 inches above the front pivot connections in a non-actuated position of the cradle actuator.

In another aspect of the lift and recliner chair, the controller is further configured to actuate the cradle actuator to move the lift-recline base forward as the at least one lift-recline actuator is actuated to raise the seat to increase a vertical lift position of the seat.

Preferably, using the present arrangement for the lift and recliner chair, the vertical lift position of the seat is at least 2 inches greater with the cradle actuator actuated and the lift-recline base moved forward than a maximum lift with the cradle actuator in a non-actuated position.

In another aspect, the at least one lift-recline actuator includes a separate lift-recline actuator and a backrest actuator. Here, the controller can be configured to actuate the cradle actuator to move the lift-recline base forward to at least partially offset an extension distance of the back from the cradle base as the backrest actuator is actuated to recline the back, and also to actuate the cradle actuator to move the lift-recline base backward as the backrest actuator is actuated to raise the back.

In one embodiment, the controller can be configured to monitor a current draw of the separate lift-recline actuator, the backrest actuator, and the cradle actuator and operate no more than two of the three actuators at a same time to prevent current overloads.

In a preferred arrangement of the lift and recliner chair, the controller includes a processor and a controller memory which may be separate from or included in a control device. The controller memory is configured to store pre-set actuator positions in a non-volatile storage medium, such as a RAM, ROM, or other storage, for the at least one lift-recline actuator and the cradle actuator that are activatable via the control device.

It is further preferred that the controller is configured to provide a fully reclined and cradle position in which the at least one lift-recline actuator is in a fully reclined position and the cradle actuator is in a forward-most extended position.

In the preferred arrangements, the at least one lift-recline actuator and the cradle actuator are electric motor driven actuators. However, other types of actuators could be used.

Preferably, the lift and recliner chair includes an extendable footrest connected to the lift and recline mechanism. Preferably, the lift and recline mechanism includes two pantograph linkages connected between the seat and the footrest.

In a further arrangement, a recliner chair is provided, and includes a recline chair mechanism providing a reclining movement, with the recline chair mechanism including a recline base. A seat and a back are connected to the recline chair mechanism, with the back being effectively connected relative to the seat. A cradle assembly as discussed above is provided, including a cradle base, rear standoffs on the cradle base with aligned rear pivot axes, rear links having first ends pivotably connected to respective ones of the rear standoffs at the rear pivot axes and second ends pivotably connected to respective ones of rear pivot connections on the recline base, front standoffs on the cradle base with aligned front pivot axes, and front links having first ends pivotably connected to respective ones of the front standoffs at the front pivot axes and second ends pivotably connected to respective ones of front pivot connections on the recline base. An actuator mount is connected to the cradle base. A cradle actuator is connected between the actuator mount on the cradle base and the recline base. A controller controls the movement of the cradle actuator. The controller can be configured to actuate the cradle actuator to move the recline base forward to at least partially offset an extension distance of the back from the cradle base to provide enhanced wall clearance. For so called "wall-hugger" recline chair mechanisms, this offsetting of the extension distance is not required.

The controller can also be configured to specifically provide for or prevent certain combined actuator movements to prevent certain positions that could cause instability or comfort issues for the user. This can include one or more of:

a. When the back is in a reclined position (backrest actuator retracted) and the cradle actuator is activated (extending), the controller is configured to extend the backrest actuator a distances equal to the movement of the cradle actuator.
b. When the chair is reclined and or the cradle actuator is extended, the controller is configured such that when a user presses the up key or the manual up keys, the cradle actuator is automatically retracted.
c. When the chair is in a reclined position using all three actuators and the up key is pressed, the controller is configured such that all three actuators reverse position and the chair lifts. This includes extending the backrest actuator to raise the back, extending the lift-recline (seat) actuator to raise the seat, and retracting the cradle actuator to lower the cradle.
d. When the seat actuator is in the lift position with the seat actuator extended past neutral (neutral is legs on the floor and the foot rest closed), the controller is configured to disable the cradle actuator so that it cannot move until the seat actuator is back in the neutral position.
e. The controller can be configured to store favorite positions using programmable keys. The favorite position buttons activate all three actuators simultaneously for comfort and are preferably restricted by the foregoing in order to prevent unsafe operation or storage of an unsafe position.

In another aspect, the cradle function can be provided by rollers or slides located on one of the cradle base or the lift-recline base that interact with guide tracks on the other of the lift-recline base or the cradle base in order to provide a similar cradling movement when the cradle actuator is actuated to move the lift-recline base forward relative to the cradle base.

In another aspect, a recliner chair is provided having a recline chair mechanism that carries out a reclining movement. The recline chair mechanism has a recline base, and a seat and a back are connected to the recline chair mechanism. The back is effectively connected relative to the seat. A cradle assembly is provided having a cradle base. A track and roller or slide system is configured to provide a forward movement of the lift-recline base and an upward tilt. The track and roller or slide system includes slides or rollers located on one of the cradle base or the recline base that interact with guide tracks on the other of the recline base or the cradle base. An actuator mount is connected to the cradle base. A cradle actuator is connected between the actuator mount on the cradle base and the recline base. A controller controls movement of the cradle actuator. The controller can be configured with one or more of the safeguards noted above to prevent certain movement combinations as well as to store favorite positions.

In another aspect, a lift and recliner chair is provided having a lift and recline chair mechanism having at least one lift-recline actuator that controls a lifting movement and a reclining movement. The lift and recline chair mechanism has a lift-recline base. A seat and a back are connected to the recline chair mechanism, with the back being effectively connected relative to the seat. A cradle assembly is provided including a cradle base and standoffs on the cradle base with aligned pivot axes. The lift-recline base is pivotably connected to the standoffs at the aligned pivot axes. An actuator mount is connected to the cradle base. A cradle actuator is connected between the actuator mount on the cradle base and the lift-recline base. A controller is provided that controls movement of the cradle actuator. The controller can be configured with one or more of the safeguards noted above to prevent certain movement combinations as well as to store favorite positions. The pivotable connection can be at a medial positon or at a rear of the cradle base.

Additionally, the features noted above and in the description below can be used separately or in combination with one another to provide various combinations and benefits of the provided features. Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
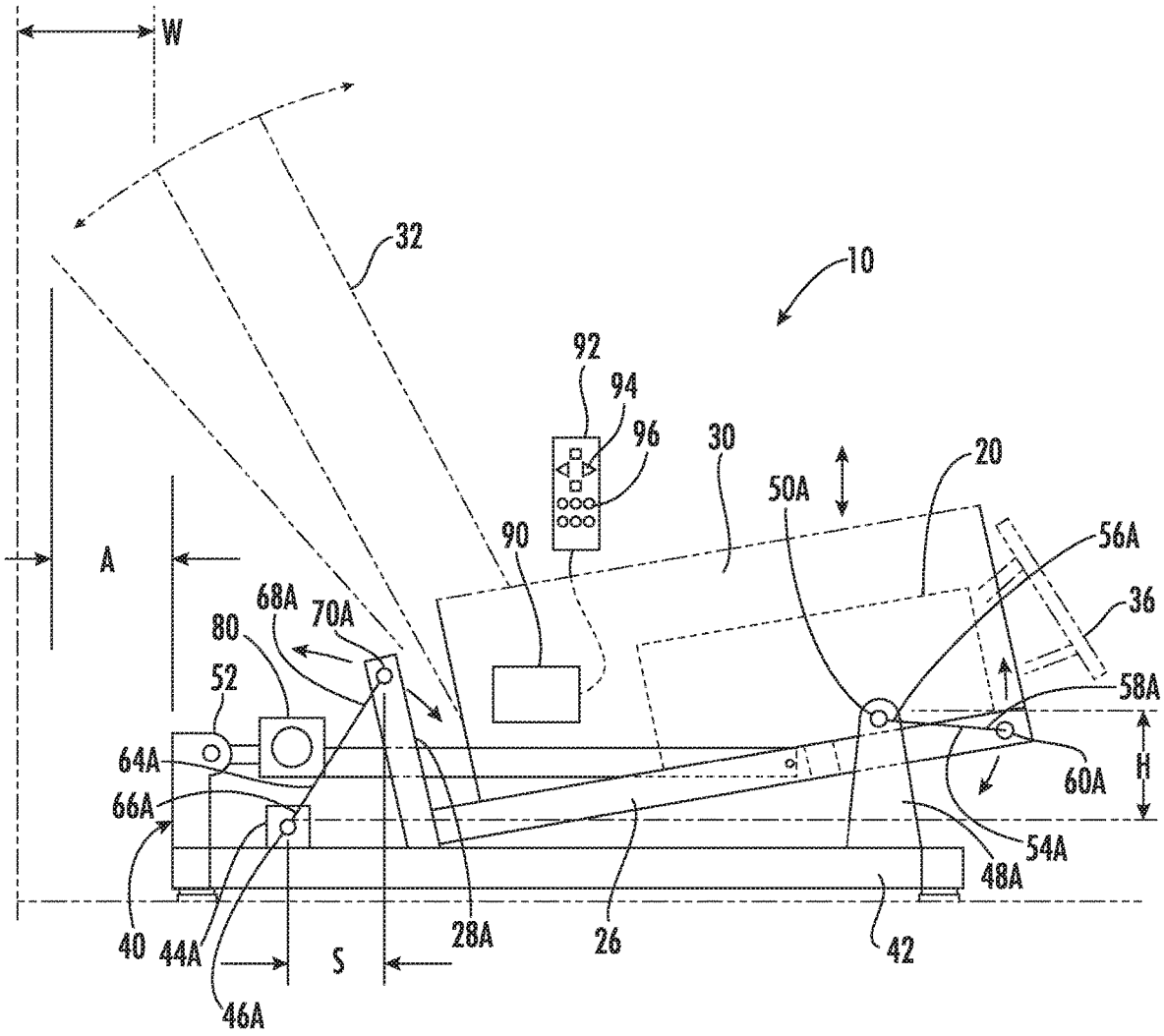
FIG. 1 is a schematic side elevational view of a lift and recliner chair in accordance with a first embodiment, shown in an extended position of the cradle assembly.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIGS. 1-9, a chair 10 in accordance with an embodiment of the present invention is shown. This can be a recliner or a lift and recline chair, with the difference being a recliner does not include a lift function, and the lift and recliner chair including both a recline function and a lift function. For the purposes of further explanation, the description that follows will refer to a lift and recliner chair, although all of the features except for the lift function would apply equally for a recliner.

The lift and recliner chair 10 includes a lift and recline chair mechanism 20 which includes the known lift and recline functions. This could be in accordance with U.S. Pat. No. 9,016,788, which is incorporated herein by reference as if fully set forth, or in accordance with other known lift and recline mechanisms using one or two actuators, such as shown in U.S. Pat. No. 8,308,228 or U.S. 2001/0035668, both of which are incorporated herein by reference as if fully set forth. The lift and recline mechanism 20 has at least one lift-recline actuator 22, shown in FIG. 8, and more preferably includes two lift-recline actuators 22, 24, with the first lift-recline actuator 22 being used to actuate the lift and recline functions of the lift and recline mechanism 20 and the second actuator 24 being a backrest actuator that can be used to separately adjust the positon of a back 32 of the chair 10 relative to the seat 30. As shown in FIGS. 1, 1A, and 2-9, the lift and recline chair mechanism 20 includes a lift-recline base 26 which forms a part of the lift and recline chair mechanism 20.

Referring to FIG. 1, the chair 10 includes the seat 30 and the back 32 connected to the lift and recline chair mechanism 20, for example, as shown in detail in FIGS. 9-18. In a preferred embodiment, the back 32 is connected to the seat 30 so as to be effectively pivotable relative thereto. This can be done with a knife hinge 34 as shown in FIGS. 9-16 or via any other suitable connection. Arms are preferably connected to the seat portion of the chair. These are shown without upholstery in the drawings for clarity and the sake of explanation.

Referring again to FIGS. 1, 1A, and 2-9, a cradle assembly 40 in accordance with the invention is shown. The cradle assembly 40 includes a cradle base 42, preferably formed of welded tubular steel. Rear standoffs 44A, 44B are connected to the cradle base 42 and include aligned rear pivot axes 46A, 46B, preferably formed via pins. Front standoffs 48A, 48B are connected to the cradle base 42. The front standoffs 48A, 48B include aligned front pivot axes 50A, 50B, preferably also formed by pins. The front pivot axes 50A, 50B are located at a first distance H above the rear pivot axes 48A, 48B. The distance H is preferably at least about 3 inches and more preferably in the range of 6 to 8 inches.

Still referring to FIGS. 1, 1A, 3, and 6-9, an actuator mount 52 is connected to the cradle base 42, preferably along the rear portion thereof. This can be formed by a pair of plates that are spaced apart in order to allow pivotable mounting of a cradle actuator as discussed in detail below.

Figure 1A:
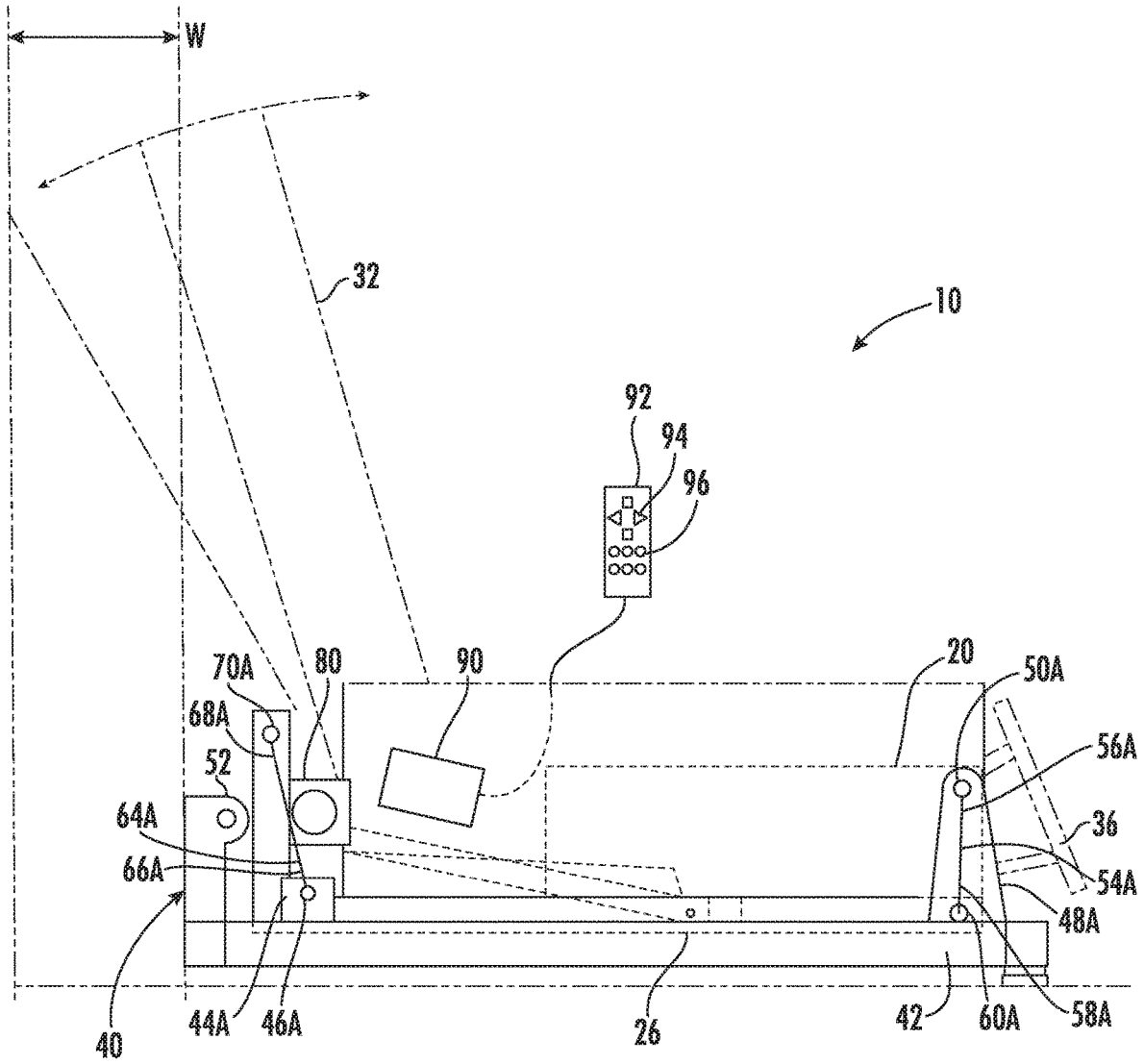
FIG. 1A is a schematic side elevational view of a lift and recliner chair in accordance with the first embodiment shown in FIG. 1, illustrated in a neutral or start position of the cradle assembly.
Figure 2:
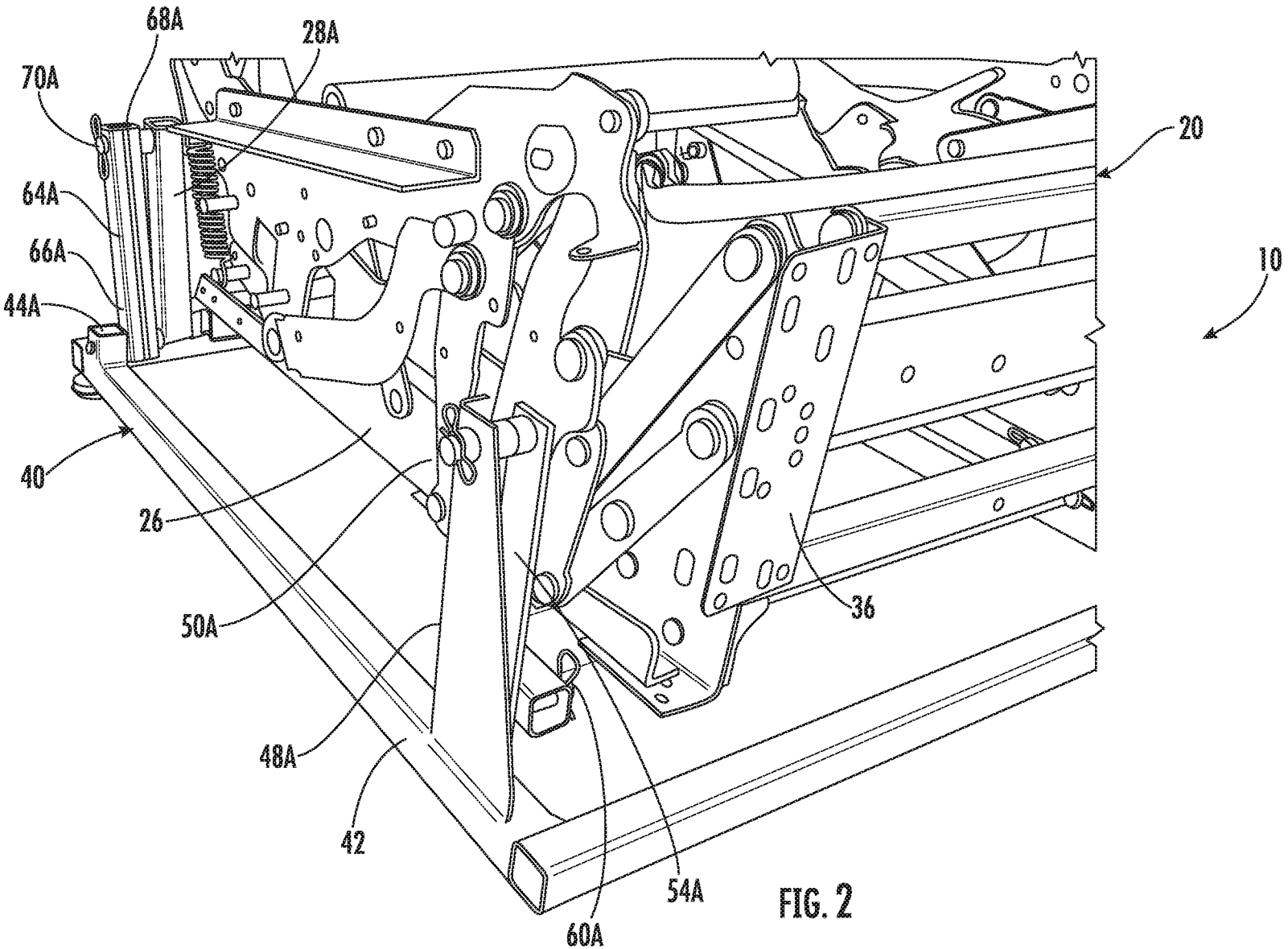
FIG. 2 is an enlarged front, right perspective view of the cradle assembly used in connection with the lift and recliner chair shown in FIG. 1.
Figure 3:
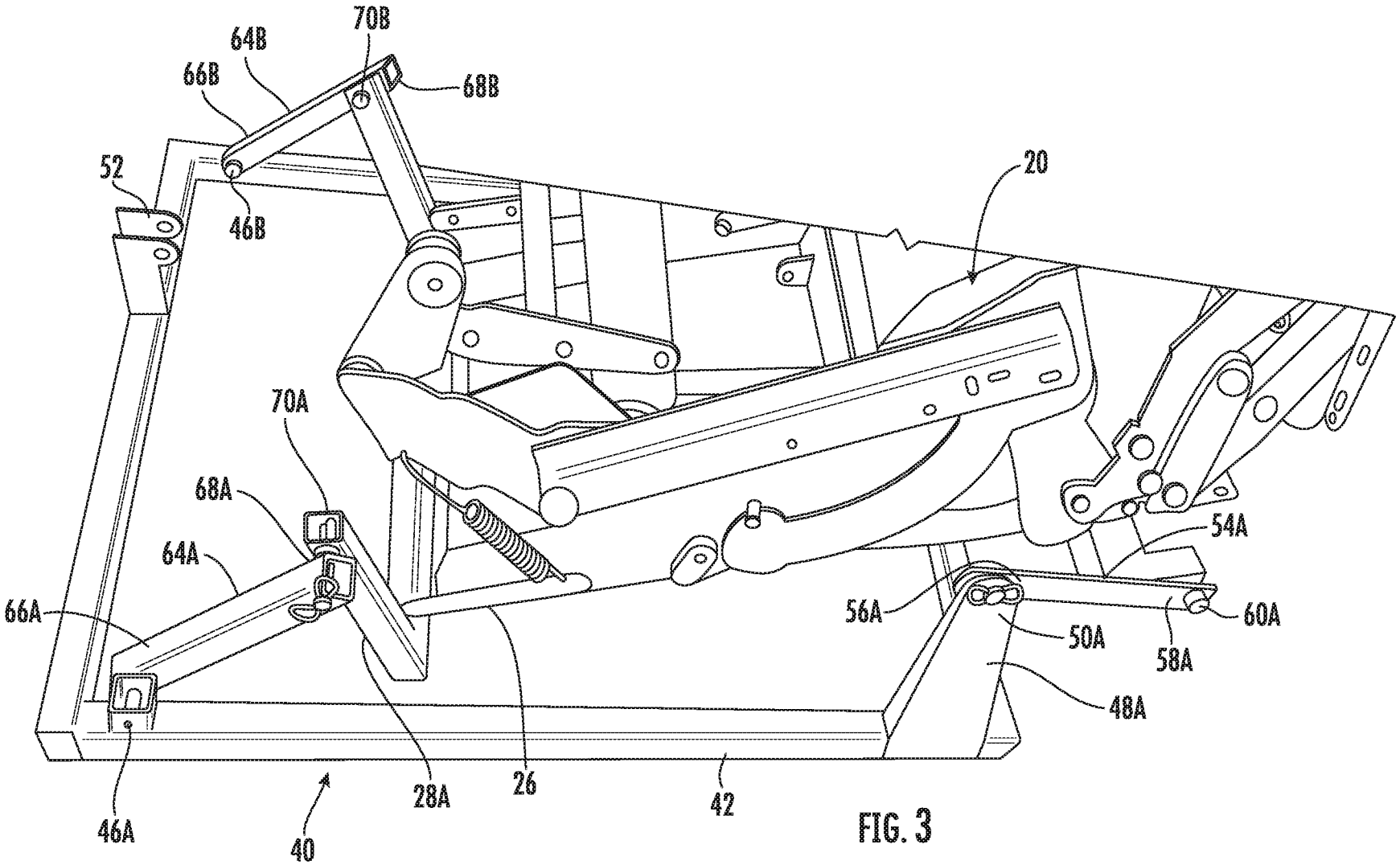
FIG. 3 is a right side perspective view of the cradle assembly for the lift and recliner chair of FIG. 1 shown in an extended position of the cradle assembly. The cradle actuator is not shown.
Figure 4:
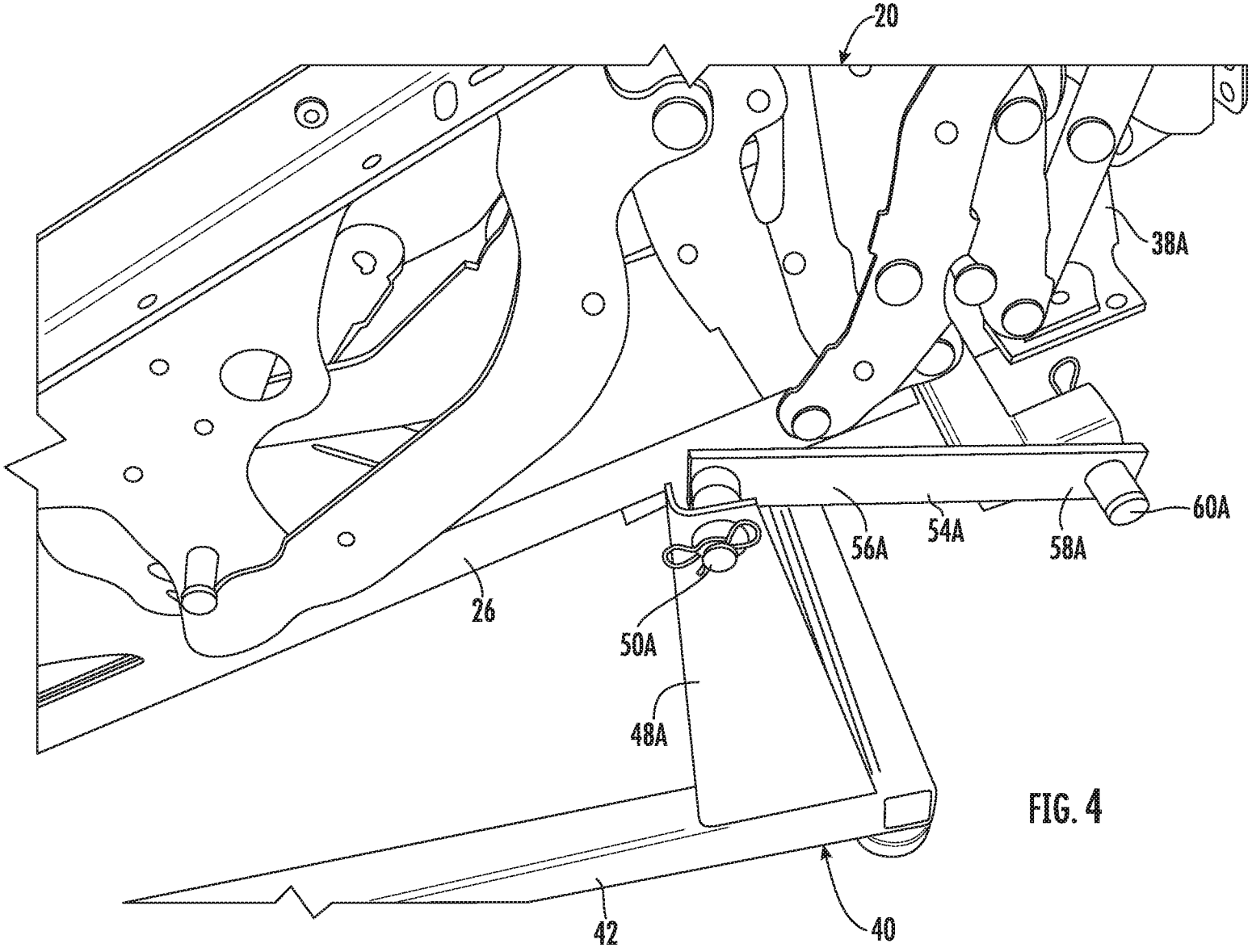
FIG. 4 is an enlarged from detail view showing the front standoff and front links for the cradle assembly of the lift and recliner chair of FIG. 1.
Figure 5:
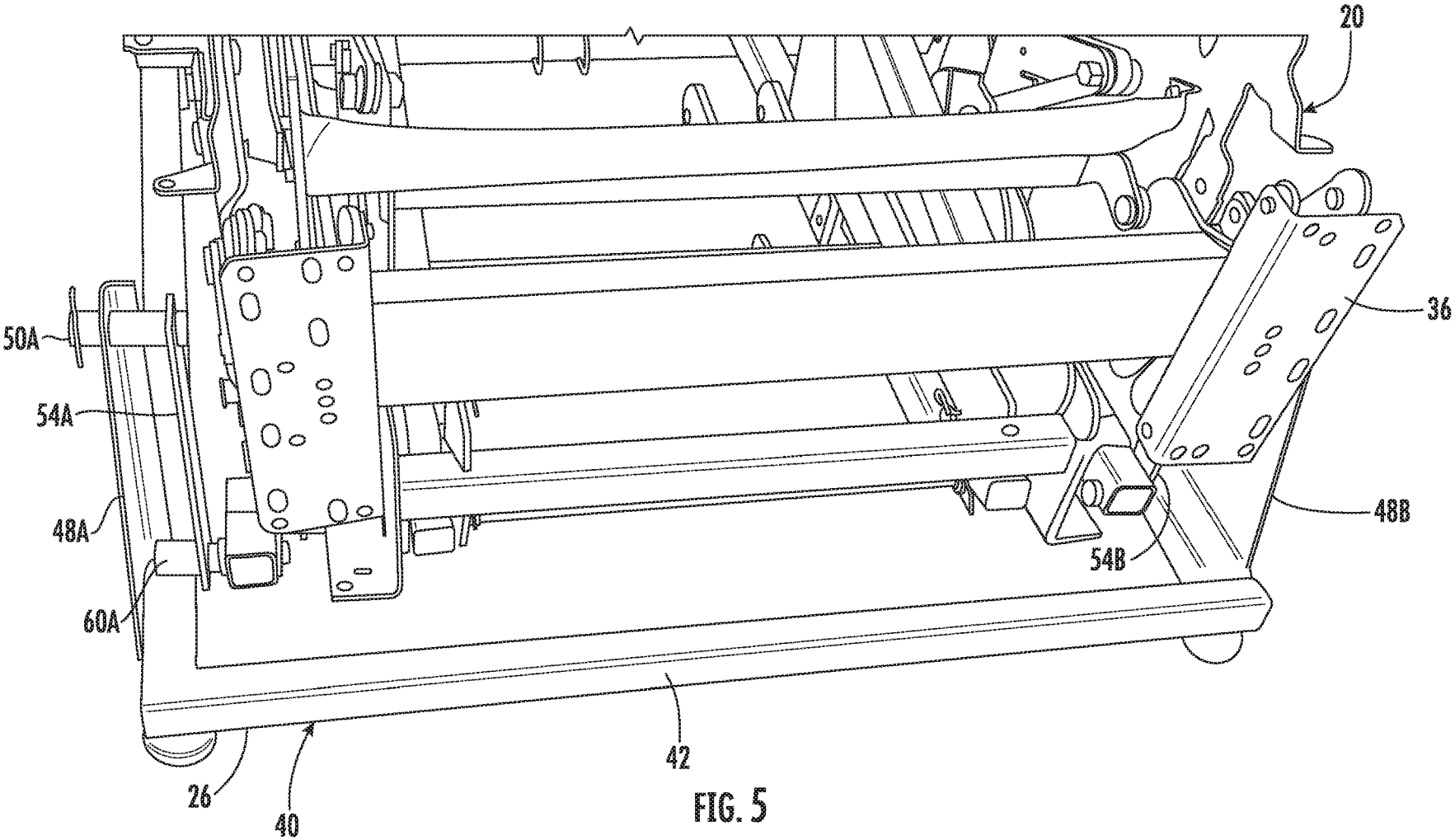
FIG. 5 is a top, front perspective view of the lift and recline chair mechanism and the cradle assembly of the lift and recliner chair of FIG. 1.
Figure 6:
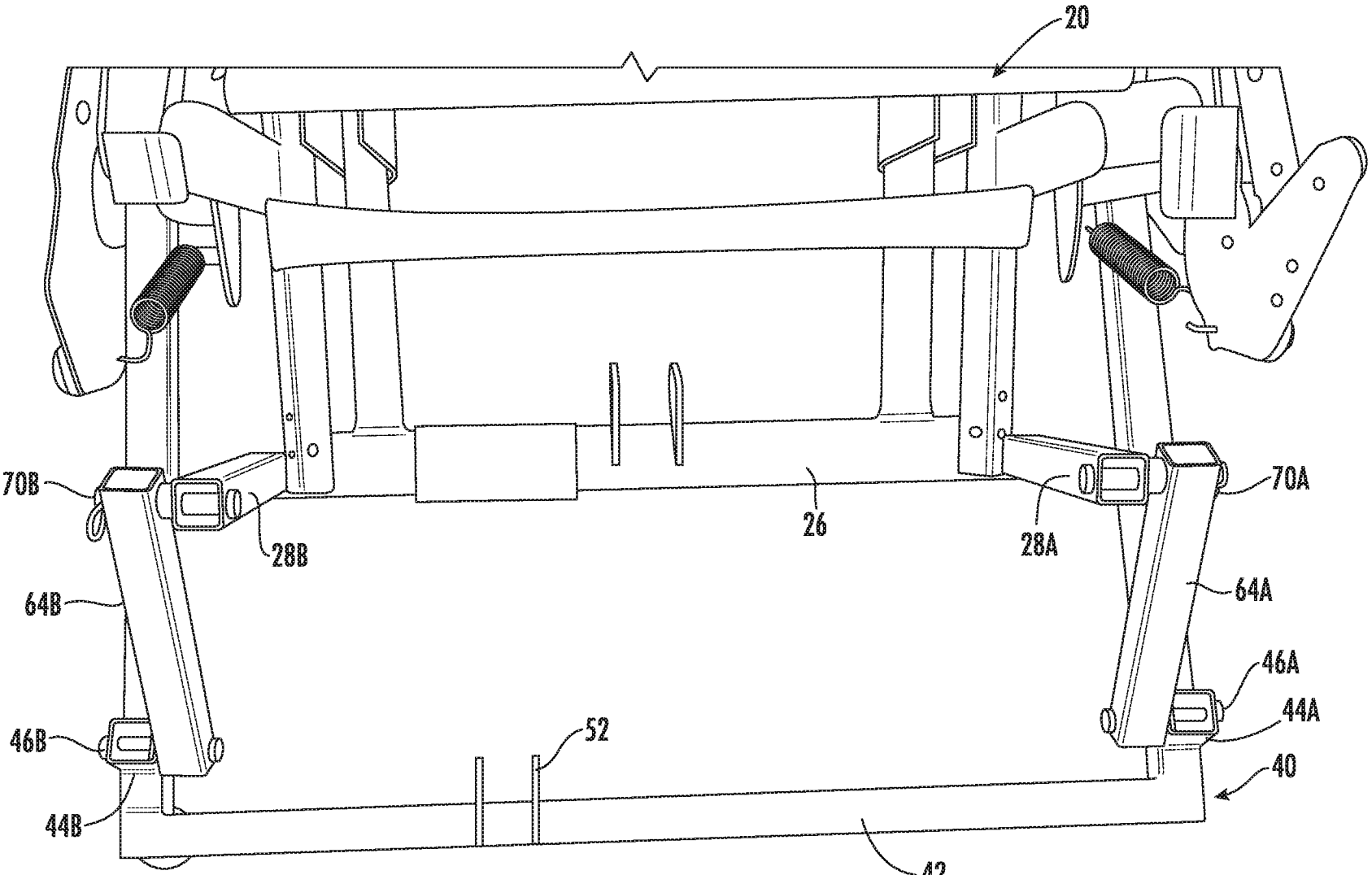
FIG. 6 is a top, rear perspective view of the lift and recline chair mechanism and the cradle assembly of the lift and recliner chair of FIG. 1.
Figure 7:
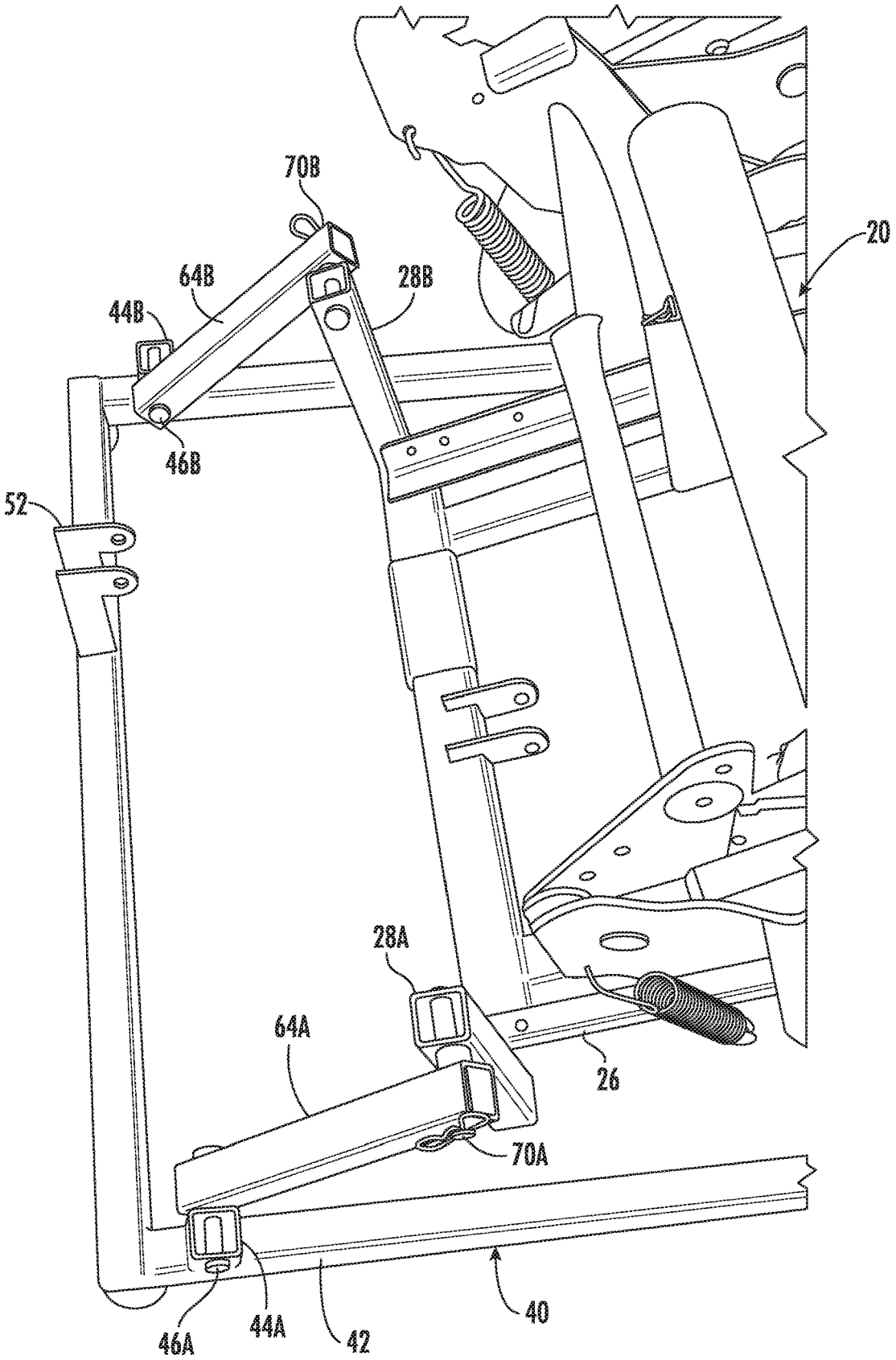
FIG. 7 is a top, right perspective view showing the rear portion of the lift and recline mechanism and the cradle assembly for the lift and recliner chair of FIG. 1.
Figure 8:
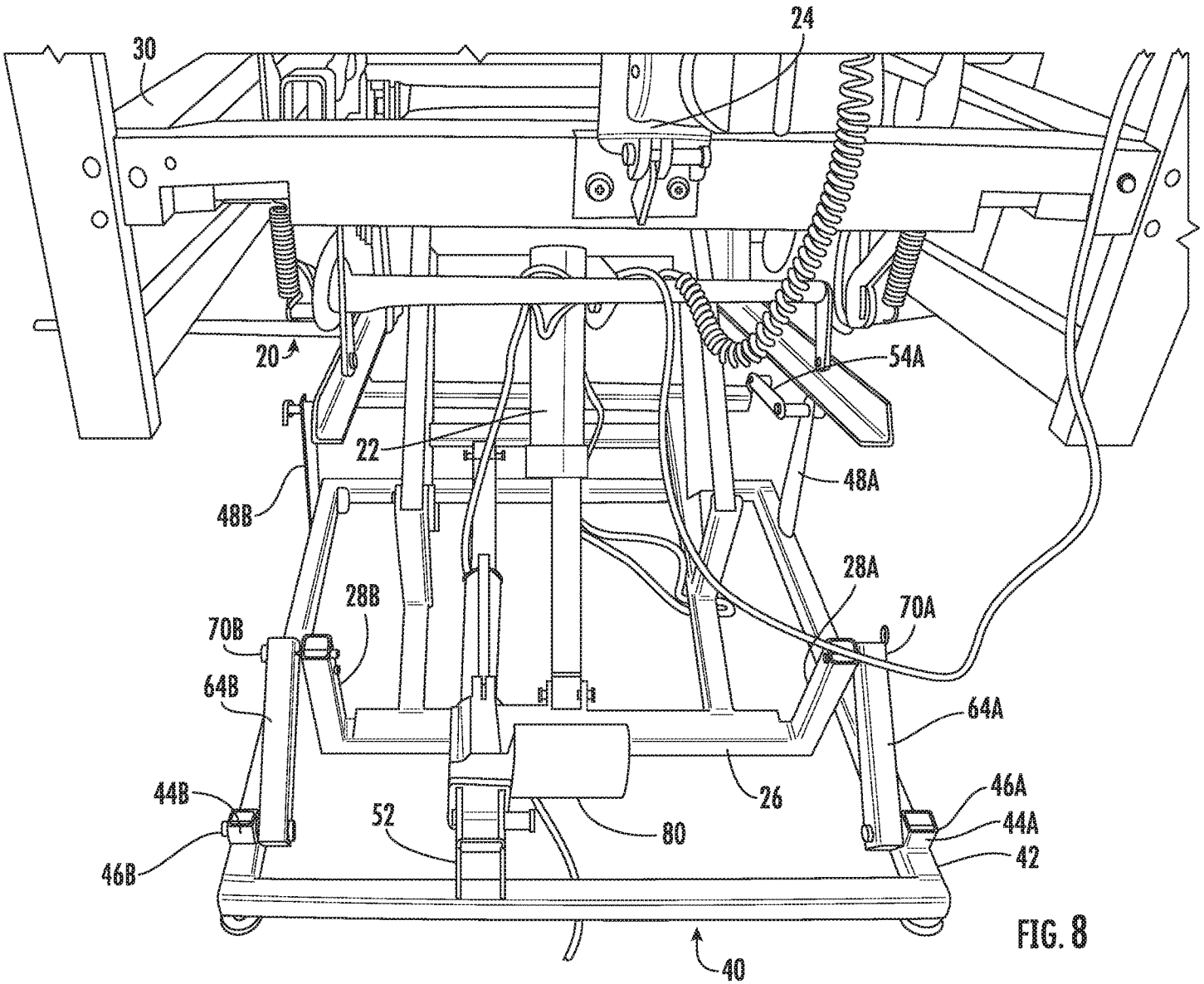
FIG. 8 is a rear view showing the lift and recliner chair with the cradle assembly in a fully extended position.
Figure 9:
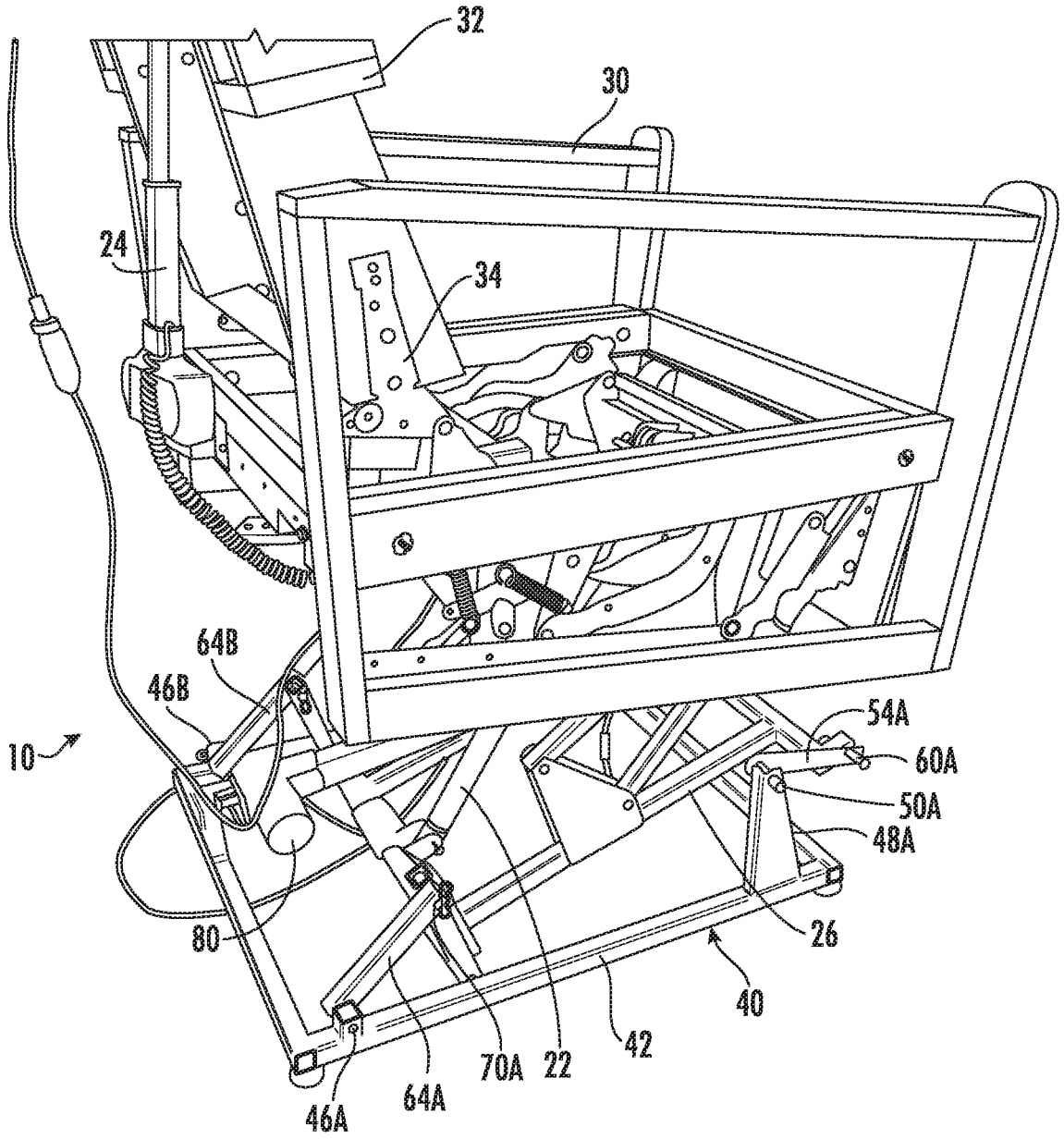
FIG. 9 is a right side rear perspective view showing the lift and recliner chair with the cradle assembly in the forward-most position.
Figure 10:
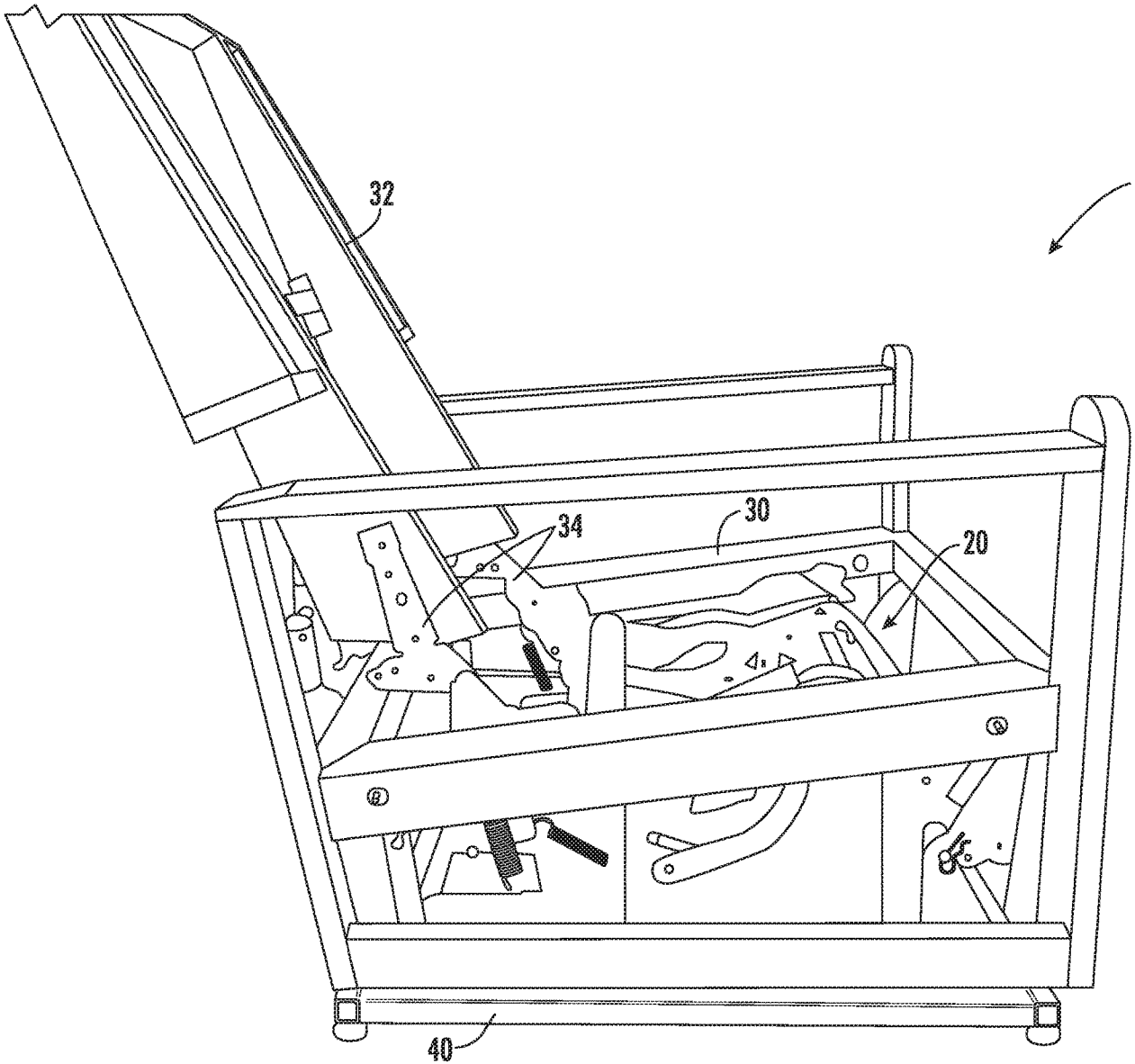
FIG. 10 is a right side view of the lift and recliner chair of FIG. 1 shown in a standard seating position.
Figure 11:
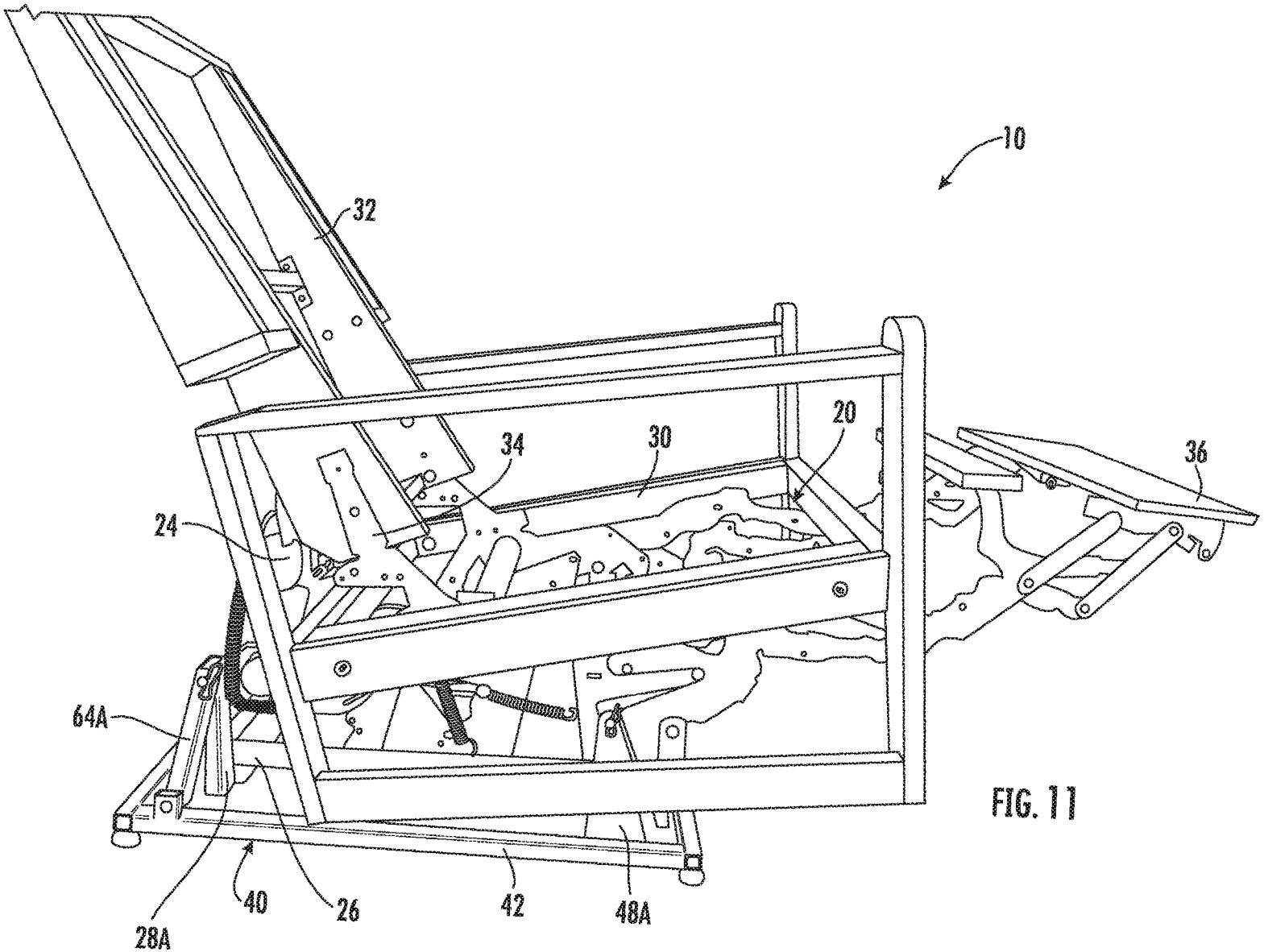
FIG. 11 is a right side view similar to FIG. 10 showing the lift and recliner chair in a wall hugger TV position in which the cradle assembly is shifted forward as the lift and recline mechanism extends the foot rest.
Figure 12:
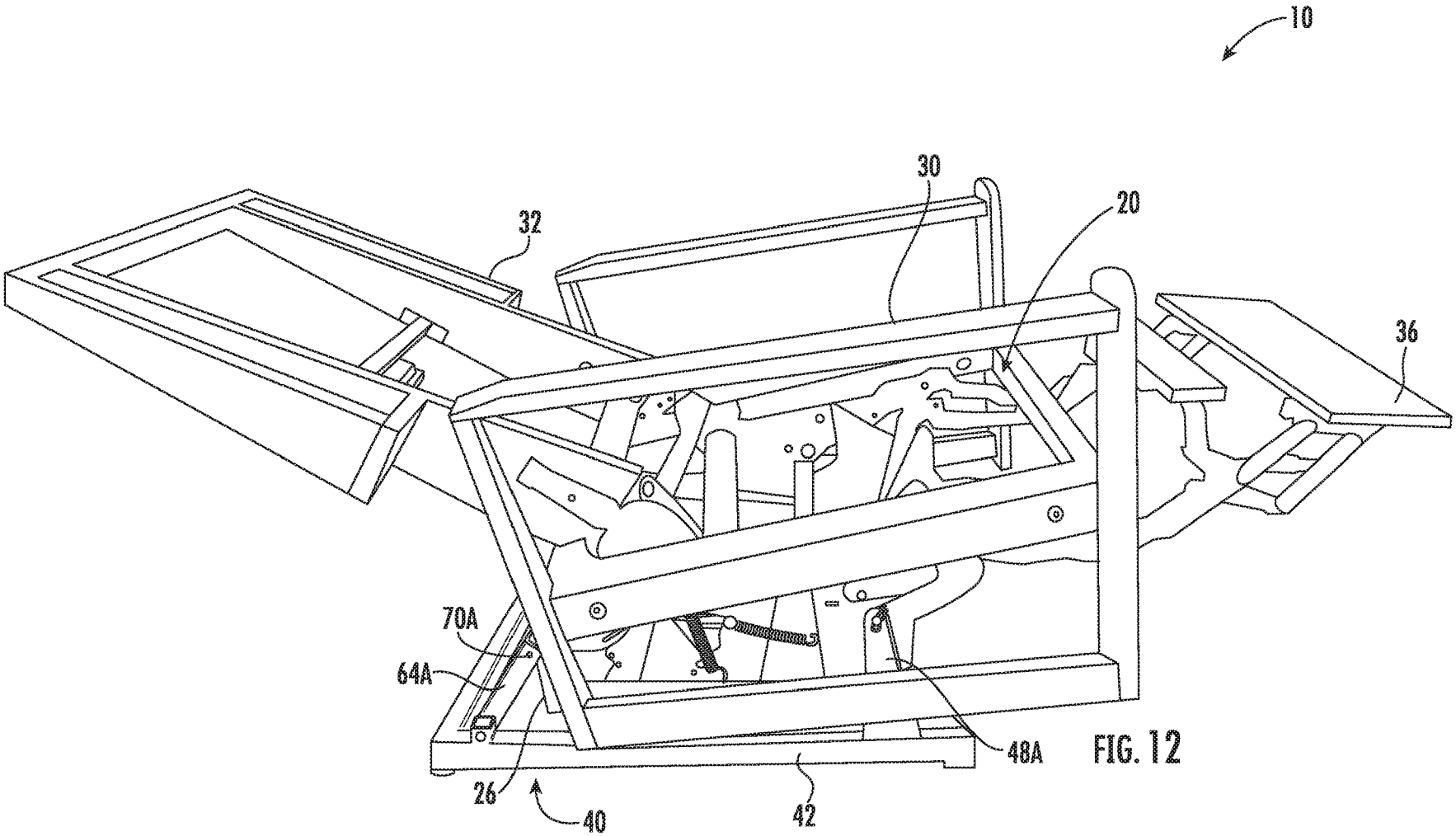
FIG. 12 is a right side view of the lift and recliner chair shown in a recline position in which the back is fully reclined and the cradle assembly is in a standard position.
Figure 13:
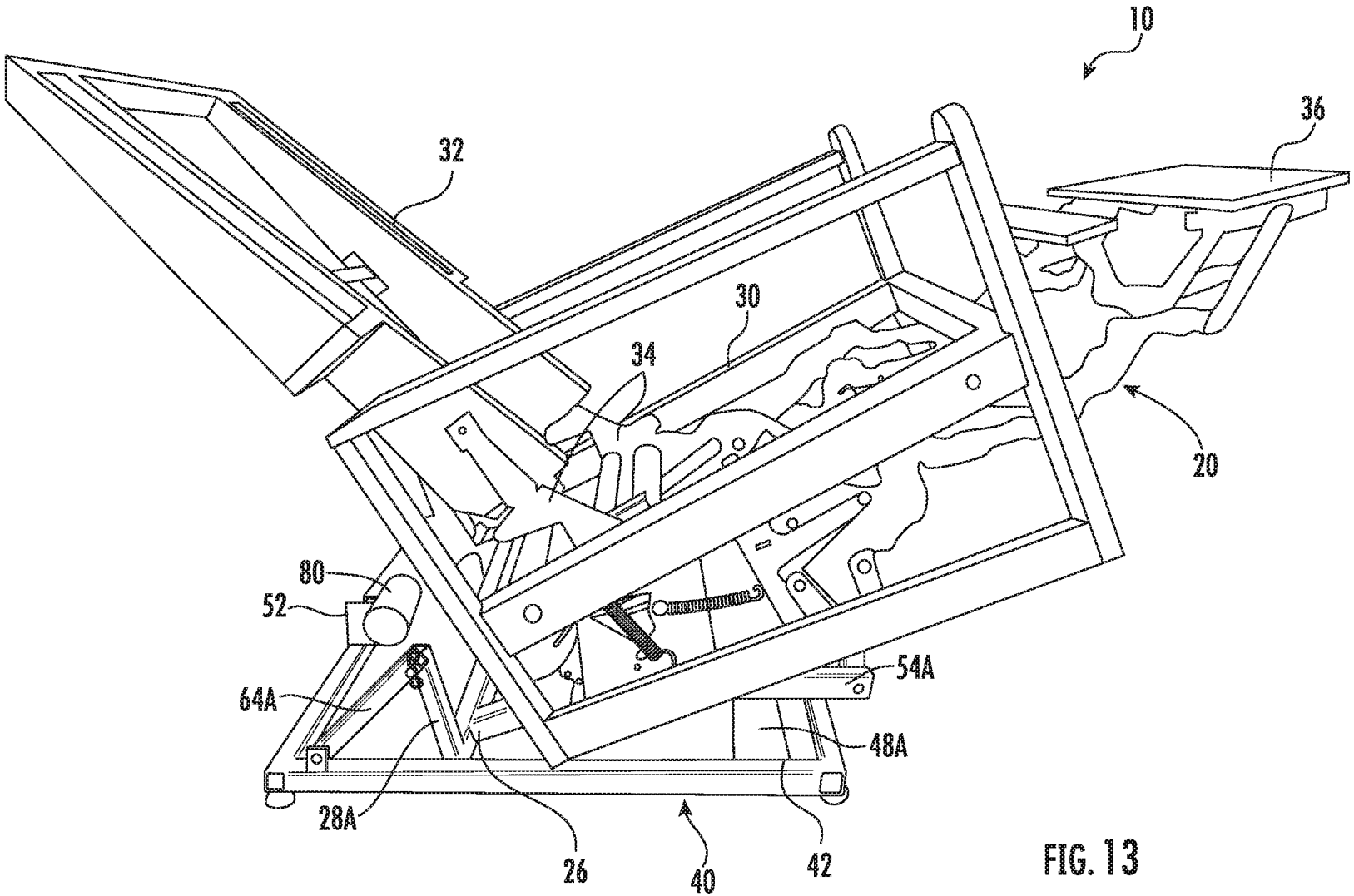
FIG. 13 is a right side view of the lift and recliner chair of FIG. 1 shown in a recline, tilt, and zero gravity position in which the cradle assembly is in a forward-most position, the foot rest is extended, and the back is only partially tilted.
Figure 14:
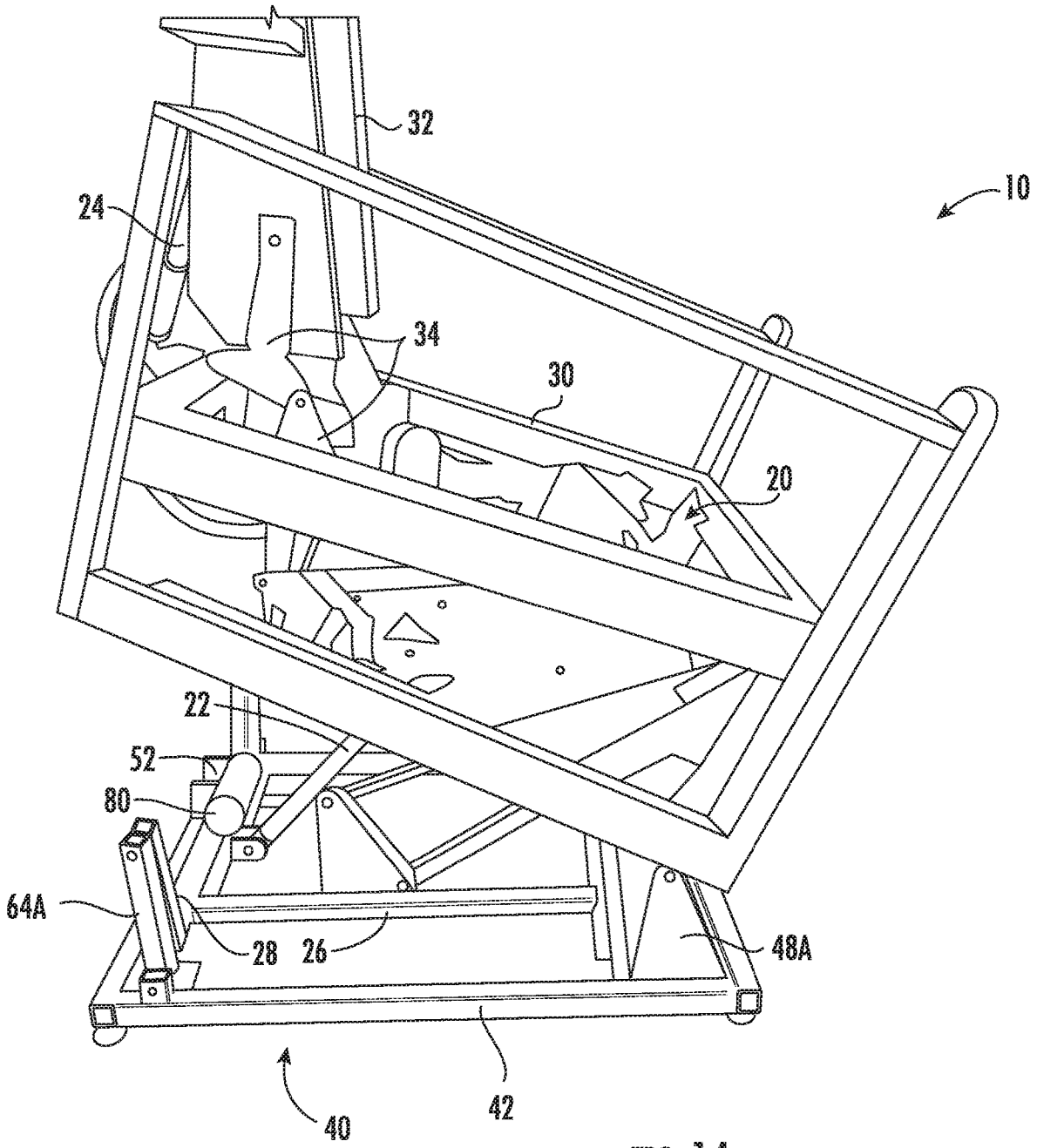
FIG. 14 is a right side view of the lift and recliner chair of FIG. 1 shown in a standard lift position in which the cradle assembly is in a non-actuated position.

Referring again to FIGS. 1, 1A, and 2-9, front links 54A, 54B having first ends 56A, 56B are pivotably connected to respective ones of the front standoffs 48A, 48B. at the front pivot axes 50A, 50B. The second ends 58A, 58B of the front links 54A, 54B are pivotably connected to respective ones of front pivot connections 60A, 60B on the lift-recline base 26. These connections are preferably also formed via pins. Rear links 64A, 64B having first ends 66A, 66B are pivotably connected to respective ones of the rear standoffs, 44A, 44B at the rear pivot axes 46A, 46B. Second ends 68A, 68B of the rear link 64, 64B are pivotably connected to respective ones of rear pivot connections 70A, 70B on the lift-recline base. These rear pivot connections are preferably also formed via pins. Preferably, as shown in detail in FIGS. 1, 1A and 7, the lift-recline base 26 includes rear uprights 28A, 28B, and the rear pivot connections 70A, 70B are located on the rear uprights, 28A, 28B. With this arrangement, the rear pivot connections, 70A, 70B on the rear uprights 28A, 28B are located above the front pivot connections 60A, 60B in a non-actuated position of the cradle assembly 40, as shown in FIG. 1A and can also be seen by comparing FIGS. 1A and 2 with FIGS. 1 and 3.

A cradle actuator 80 is connected between the actuator mount 52 and the lift-recline base 26. The connection with the actuator mount 52 is preferably a pinned connection in order to allow the actuator to be able to pivot during actuation based on the travel of the lift-recline base 26 relative to the cradle base 42.

A controller 90, shown schematically in FIG. 1, is provided that controls the movement of the cradle actuator 80 and the at least one lift-recline actuator 22, 24. The controller 90 preferably includes a processor and a fixed memory, such as a RAM or EPROM. The controller 90 is configured to actuate the cradle actuator 80 to move the lift-recline base 26 forward. In the first embodiment of the lift and recliner chair 10 this movement can be coordinated such that the movement of the lift-recline base 26 forward is done at the same time that the at least one lift-recline actuator 22, 24 is actuated to recline the back 32 to at least partially offset an extension distance A of the back 32 from the cradle base. This provides the advantage that the wall distance W is compensated for as the cradle actuator 80 increases the distance S of forward travel of the lift-recline base 26, allowing the back 32 to be reclined either separately or together with the entire lift and recline chair mechanism 20 being moved into one or more different recline positions, for example as shown in FIGS. 12, 13, 16, 18, and 19. Further, as can be seen in comparing FIG. 12, which is a fully reclined position of the lift and recline chair mechanism 20 without actuation of the cradle actuator 80, to the position of the chair 10 shown in FIG. 16, in which the lift and recline chair mechanism 20 is fully actuated along with the cradle actuator 80 being fully actuated, the cradle assembly 40 provides an enhanced zero gravity mode with a full cradle position.

Figure 15:
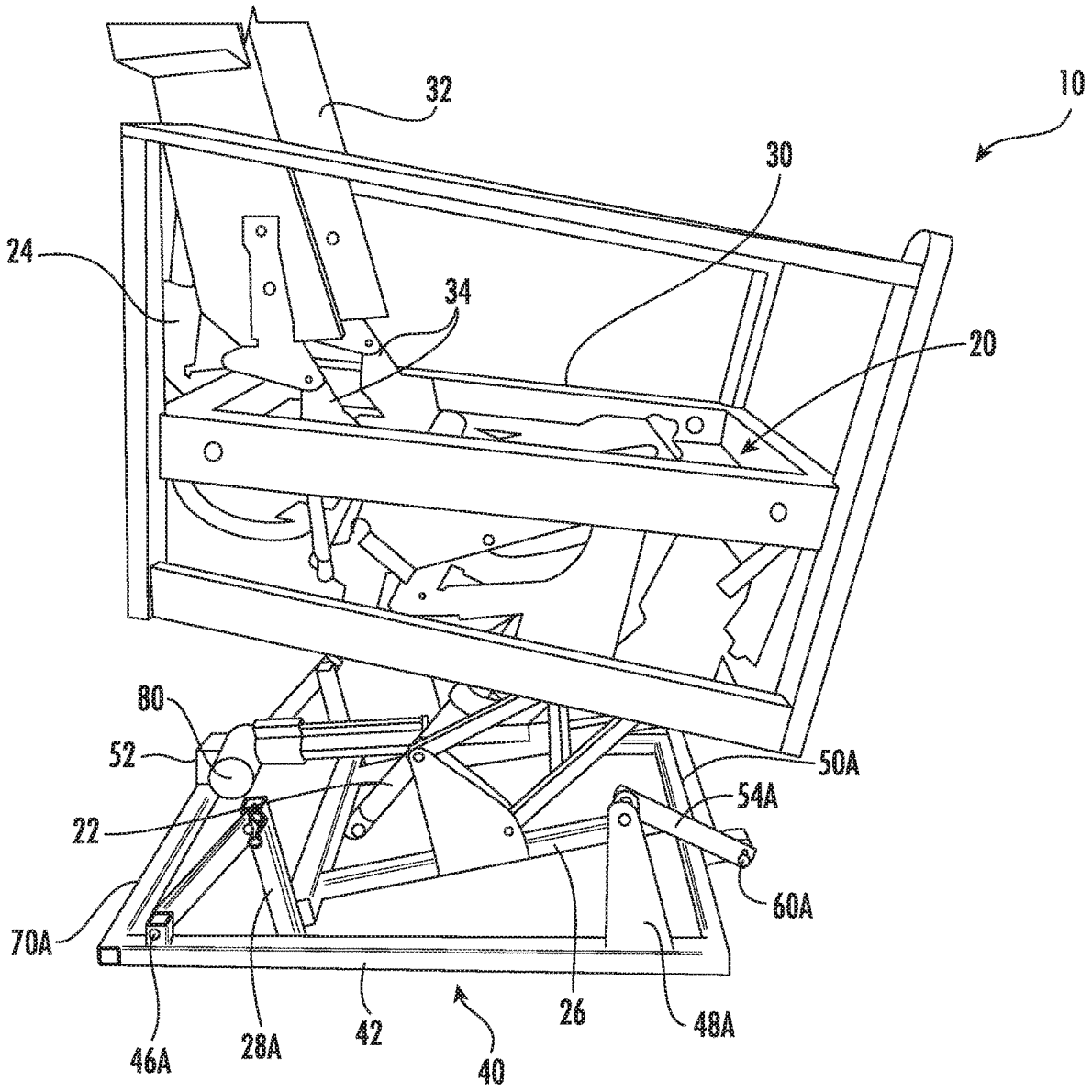
FIG. 15 is a right side view of the lift and recliner chair of FIG. 1 in a straight lift position in which the lift and recline chair mechanism is actuated to lift and the cradle assembly is actuated to provide a straight lift in which the chair seat is lifted upwardly.

Preferably, the controller 90 is further configured to actuate the cradle actuator 80 to move the lift-recline base 26 forward as the at least one lift-recline actuator 22, 24 is actuated to raise the seat 30 to increase a vertical lift position of the seat 30 in comparison to a standard lift mode. This can be seen in a comparison of FIGS. 14 and 15, where FIG. 15 provides the enhanced lift or straight lift mode. This preferably provides the vertical lift position of the seat being at least two inches greater, and more preferably, at least four inches greater than actuation of the cradle actuator 80 in the lift mode in which the lift-recline base 26 is moved forward in comparison to a maximum lift with the cradle actuator 80 in a non-actuated position.

Preferably, when a separate lift-recline actuator 22 is provided along with a backrest actuator 24, the controller 90 is configured to actuate the cradle actuator 80 to move the lift-recline base 26 forward to at least partially offset an extension distance A of the back 32 from the cradle base 26 as the backrest actuator 24 is actuated to recline the back 32. Further, the controller 90 is preferably configured to actuate the cradle actuator 80 to move the lift-recline base 26 backward as the backrest actuator 24 is actuated to raise the back 32. This allows placement of the chair 10 with a smaller distance between the chair back 32 and the wall.

Preferably, the controller 90 is configured to specifically provide for or prevent certain combined actuator movements to prevent certain positions that could cause instability or comfort issues for the user. This can include one or more restrictions or simultaneous actuations of one or more of the lift-recline (or seat) actuator 22, backrest actuator 24, and the cradle actuator 80 as shown in FIGS. 28-31.

Figure 28:
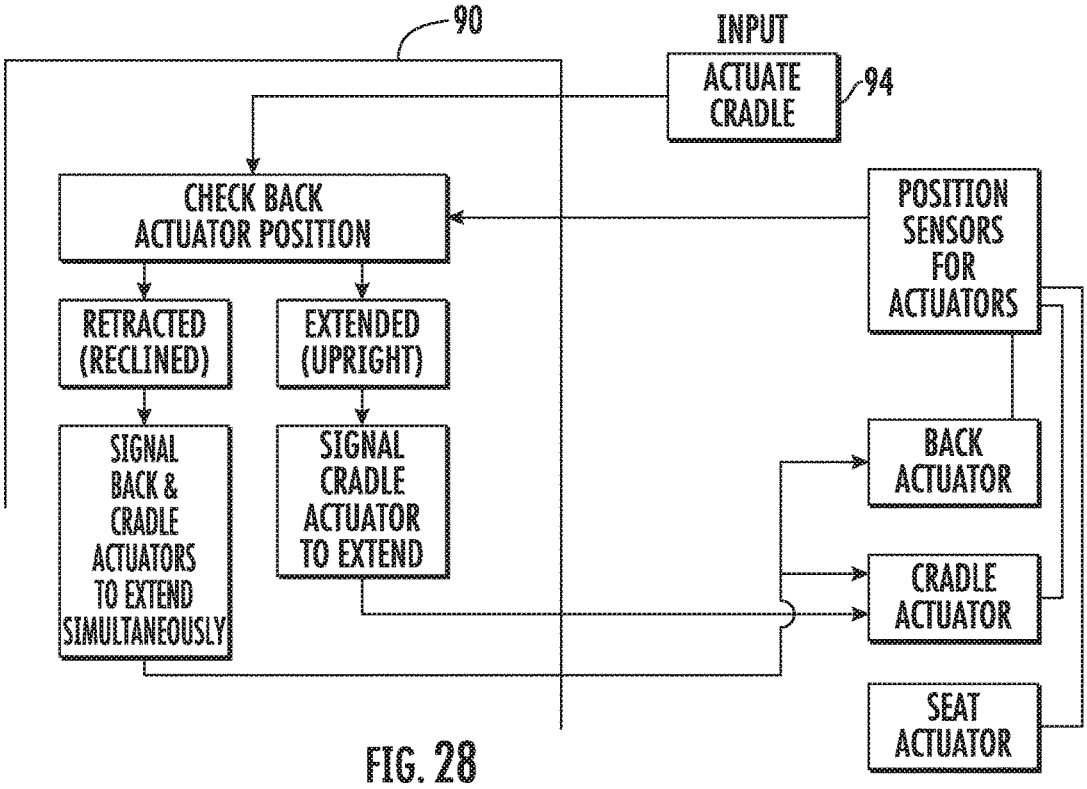
FIG. 28 is a flow chart for the controller logic for an "actuate cradle" input.

As shown in FIG. 28, one restriction by the controller 90 is that when the back is in a reclined position (backrest actuator 24 retracted) and the cradle actuator 80 is activated (extending to the cradle position), the controller 90 is configured to extend the backrest actuator 24 a distances equal to the movement of the cradle actuator 80.

Figure 29:
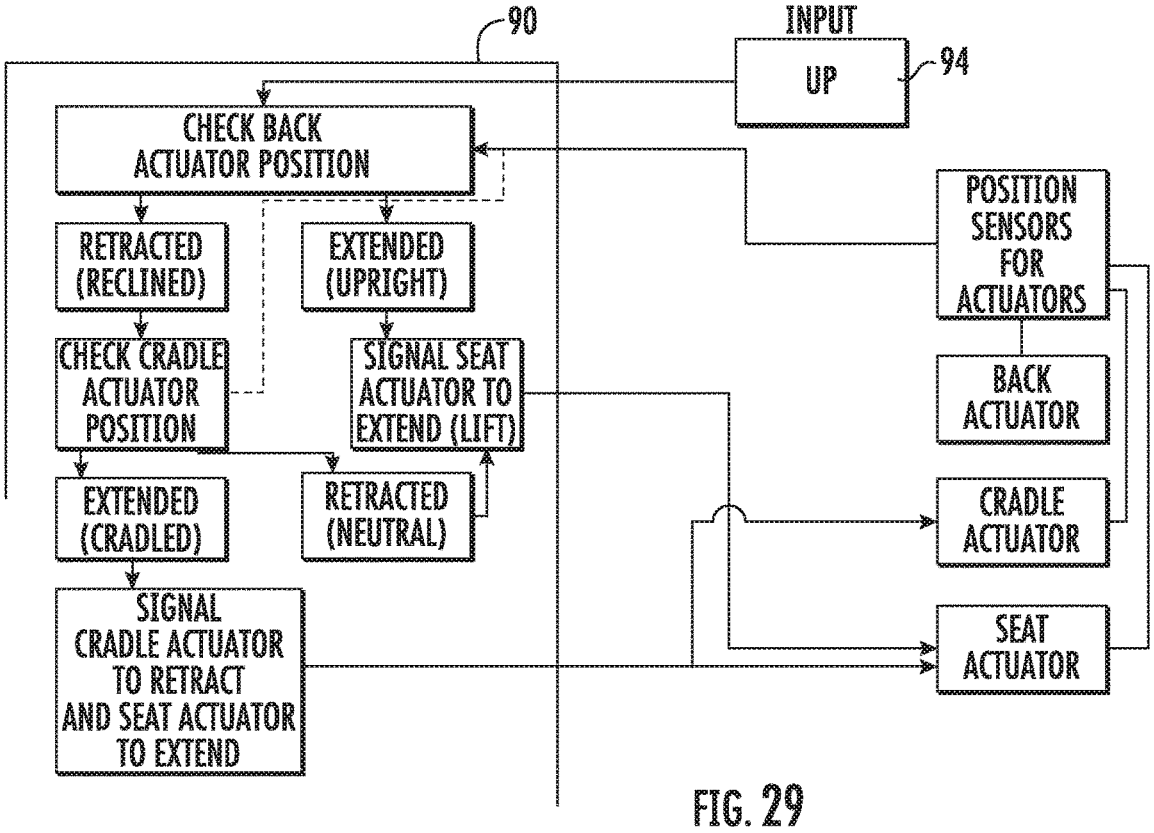
FIG. 29 is a flow chart for the controller logic for an "up" input.

As shown in FIG. 29, one restriction by the controller 90 is that when the chair is reclined (backrest actuator 24 retracted) and the cradle actuator 80 is extended, the controller 90 is configured such that when a user presses the up key or the manual up keys, the cradle actuator 80 is automatically retracted.

Figure 30:
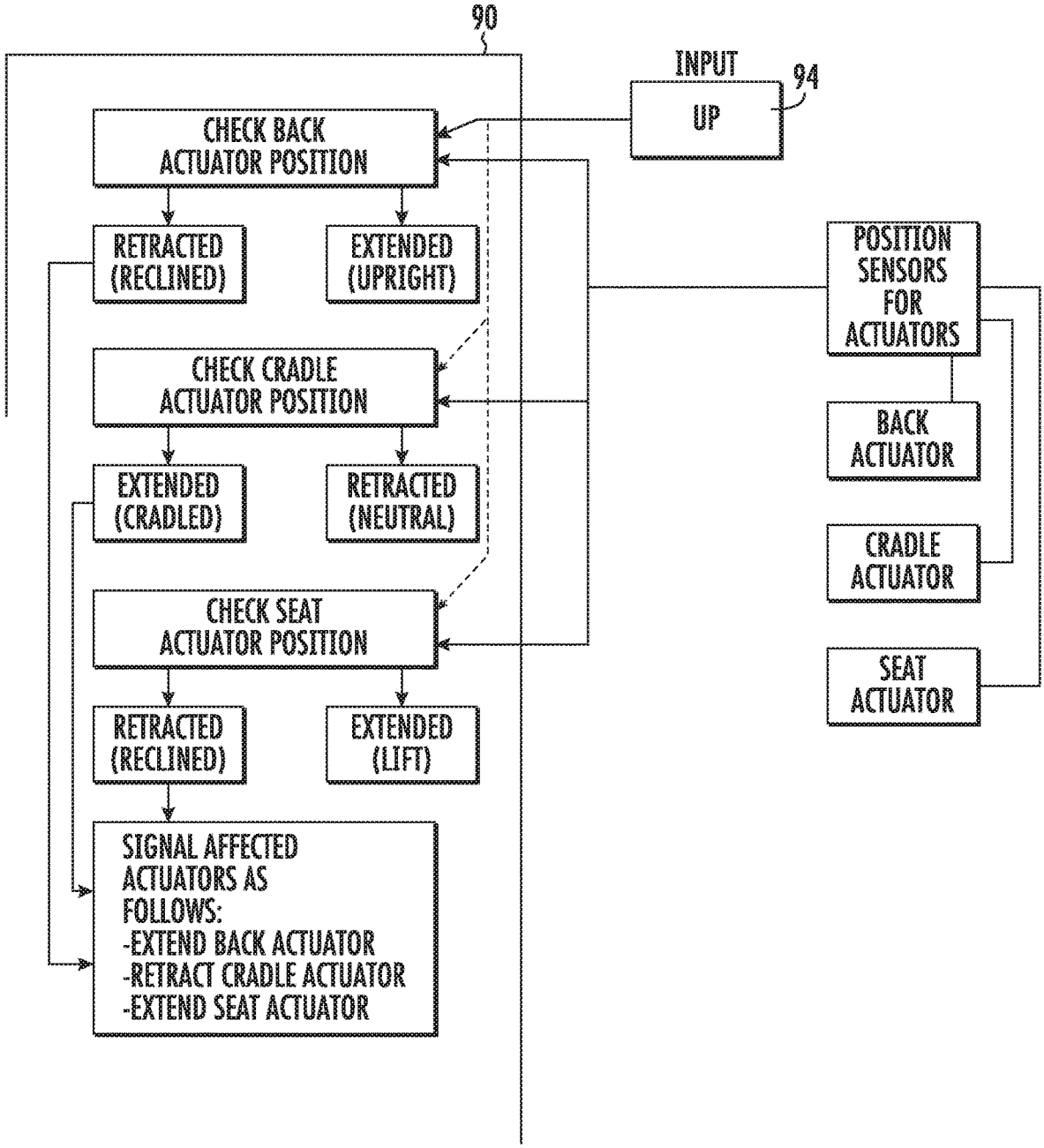
FIG. 30 is a flow chart for the controller logic for an "up" input.

As shown in FIG. 30, one restriction by the controller 90 is that when the chair is in a reclined position using all three actuators and the up key is pressed, the controller 90 is configured such that all three actuators 22, 24, 80 reverse position and the chair lifts. This includes extending the backrest actuator 24 to raise the back, extending the seat actuator 22 to raise the seat, and retracting the cradle actuator 80 to lower the cradle assembly 40.

Figure 31:
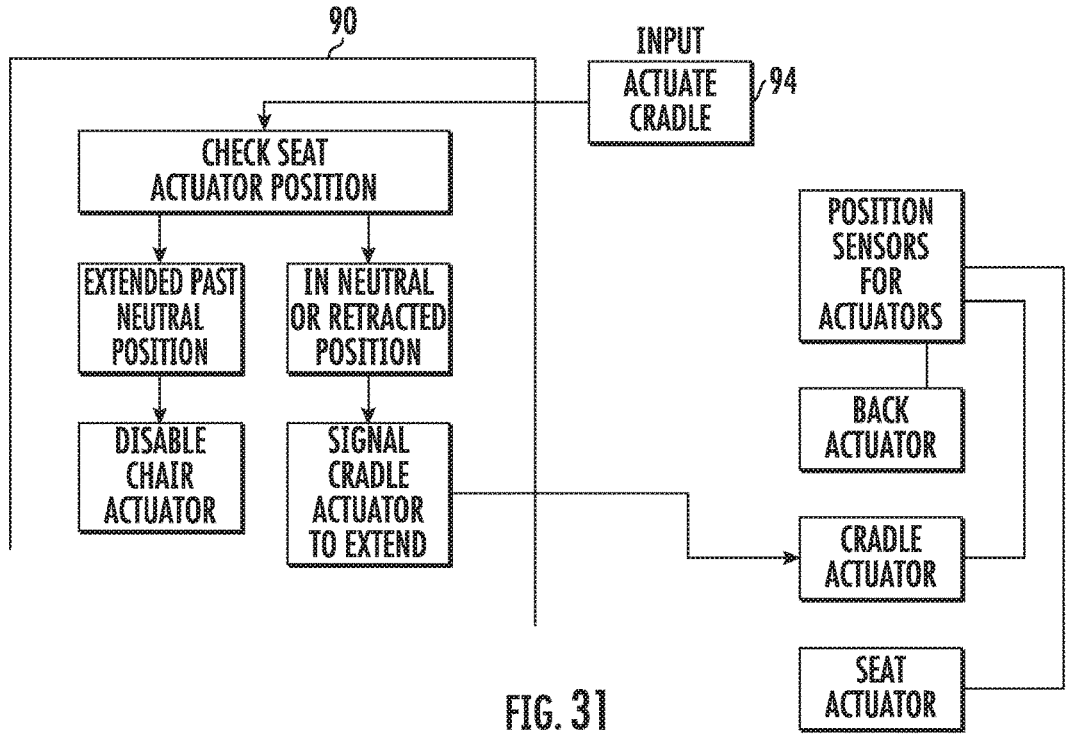
FIG. 31 is a flow chart for the controller logic for an "actuate cradle" input.

As shown in FIG. 31, one restriction by the controller 90 is that when the seat actuator 22 is in the lift position with the seat actuator 22 extended past neutral (neutral is considered a legs on the floor for an average user and the foot rest closed), the controller 90 is configures to disable the cradle actuator 80 so that it cannot move until the seat actuator 22 is back in the neutral position.

Figure 32:
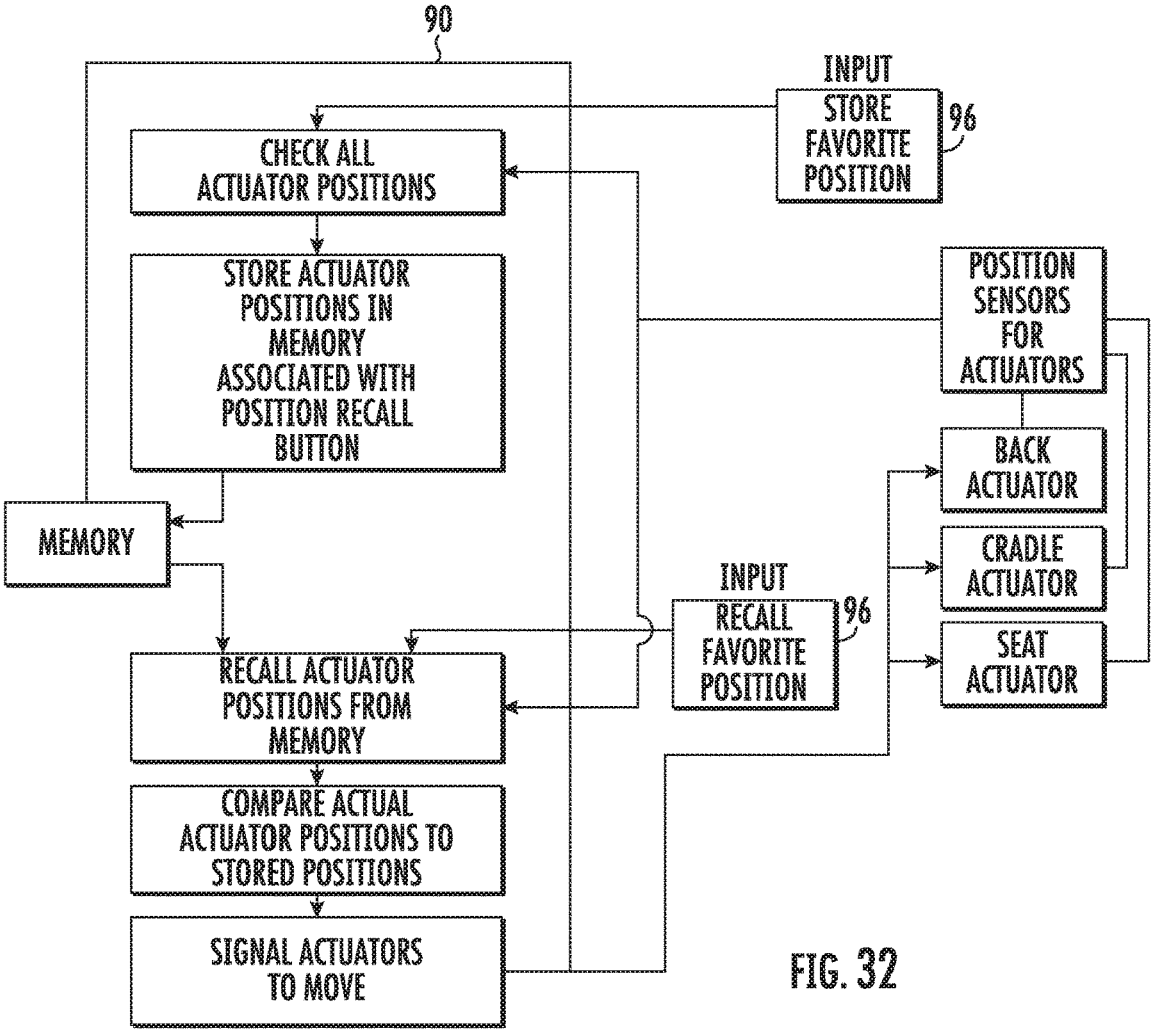
FIG. 32 is a flow chart for the controller logic for storing and retrieving a favorite position.

Additionally, as shown in FIG. 32, the controller 90 can be configured to store favorite positions using programmable keys. The favorite position buttons activate all three actuators 22, 24, 80 simultaneously or is a pre-defined staged manner for comfort and are preferably restricted by one or more of the prior restrictions as shown in FIGS. 28-31 in order to prevent unsafe operation or storage of an unsafe position.

Those skilled in the art will recognize that other limitations could be programmed into the controller 90 in order to prevent the actuators 22, 24, 80 from being moved into various other positions.

In a preferred embodiment, the actuators 22, 24, 80, are preferably electrically driven linear actuators, and the controller 90 can be configured to monitor a current draw of the separate lift-recline actuator 22, the backrest actuator 24, and the cradle actuator 80 to determine position, or separate position sensors can be used in connection with each of the actuators 22, 24, 80, such as Hall effect sensors, and the position information transmitted to the controller 90. Other types of encoders can also be used for sensing the actuator positions, if desired, depending on the particular actuators being used.

In one embodiment, the controller 90 can be programmed to operate no more than two of the three actuators at a same time to prevent current overloads and monitors the current draw of the actuators for this purpose. This allows the use of a smaller transformer in connection with powering the electric motor drives for the actuators 22, 24, 80.

Figure 16:
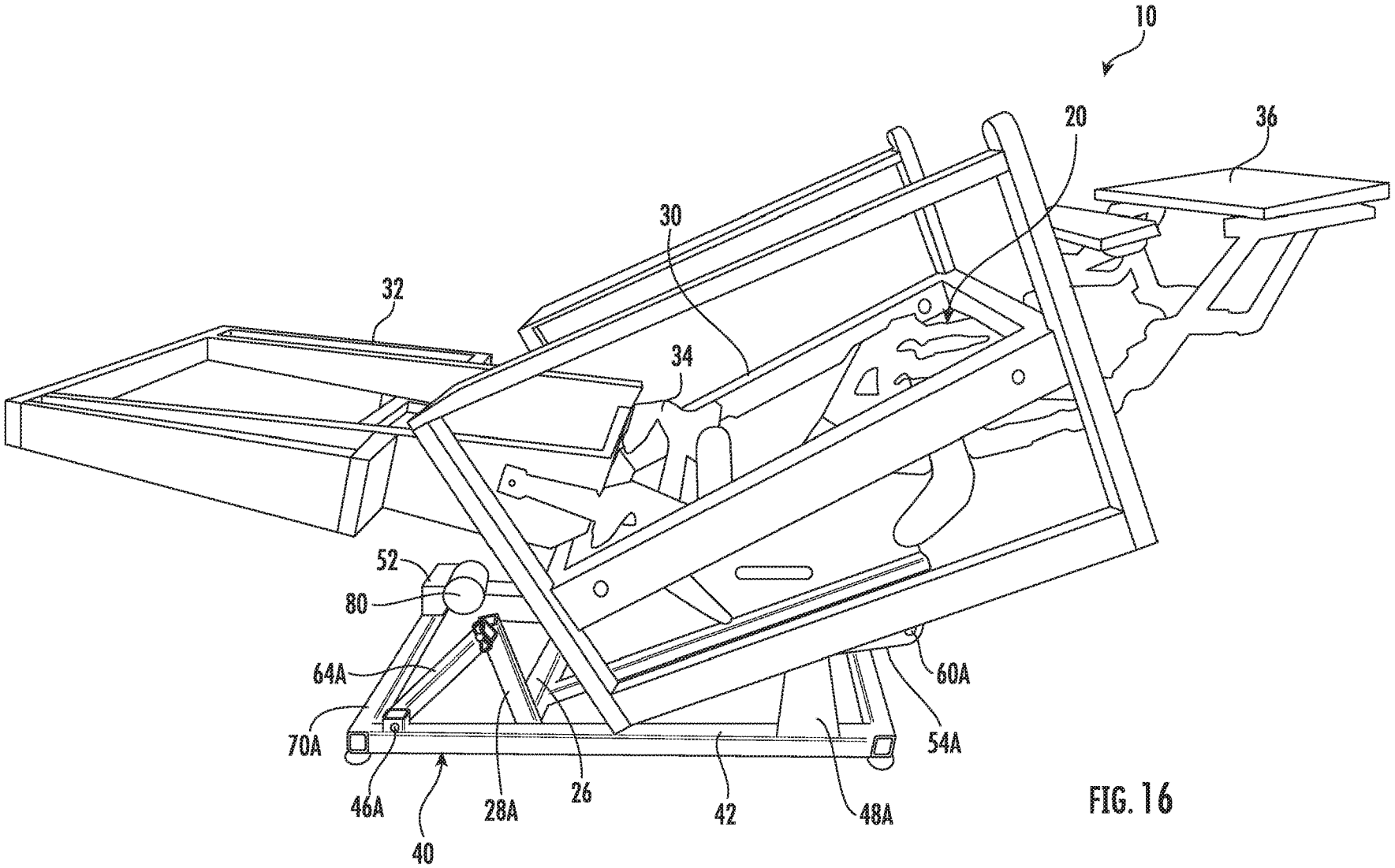
FIG. 16 is a right side view of the lift and recliner chair of FIG. 1 in a fully reclined, cradle position in which the lift and recline chair mechanism is fully reclined and the cradle assembly is fully actuated.
Figure 17:
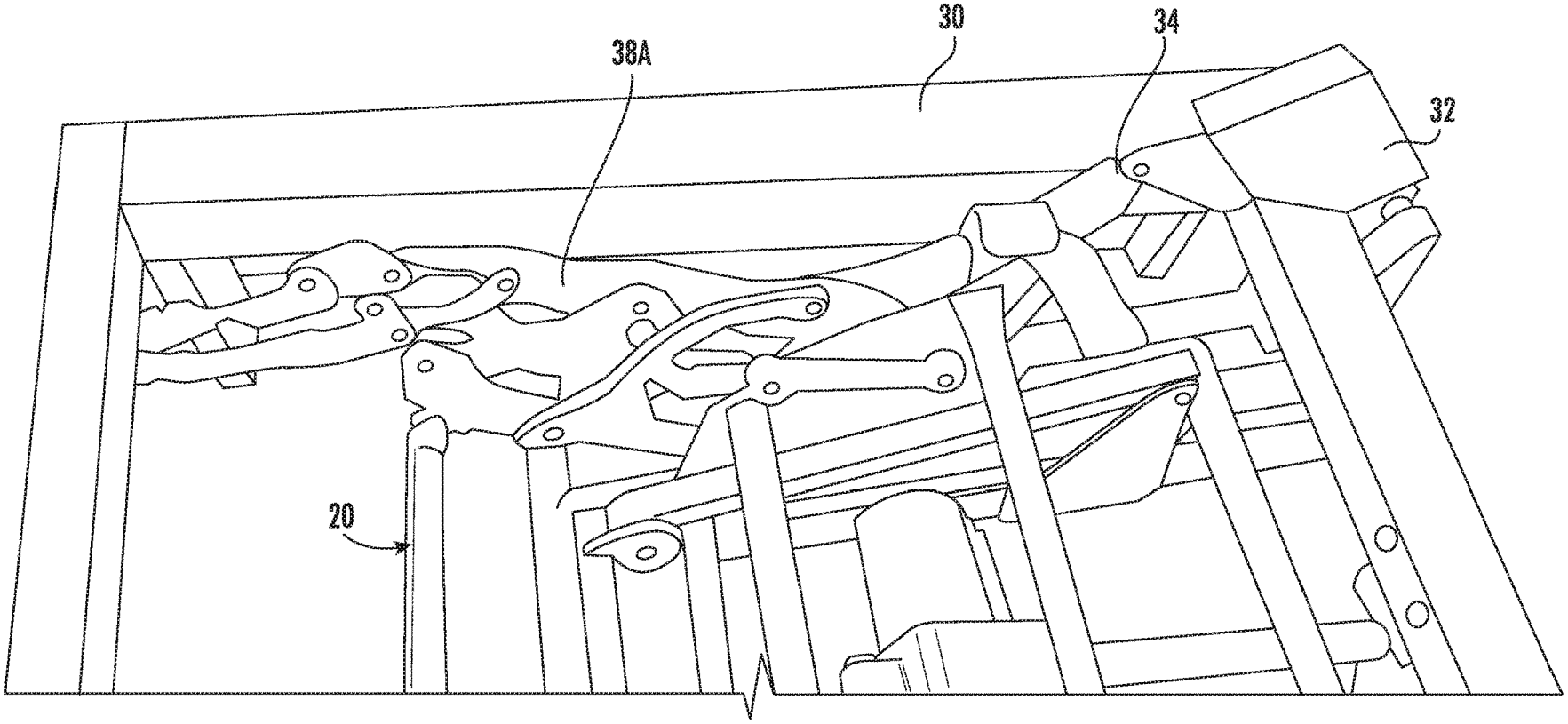
FIG. 17 is a top perspective view showing a portion of the lift and recline chair mechanism.
Figure 18:
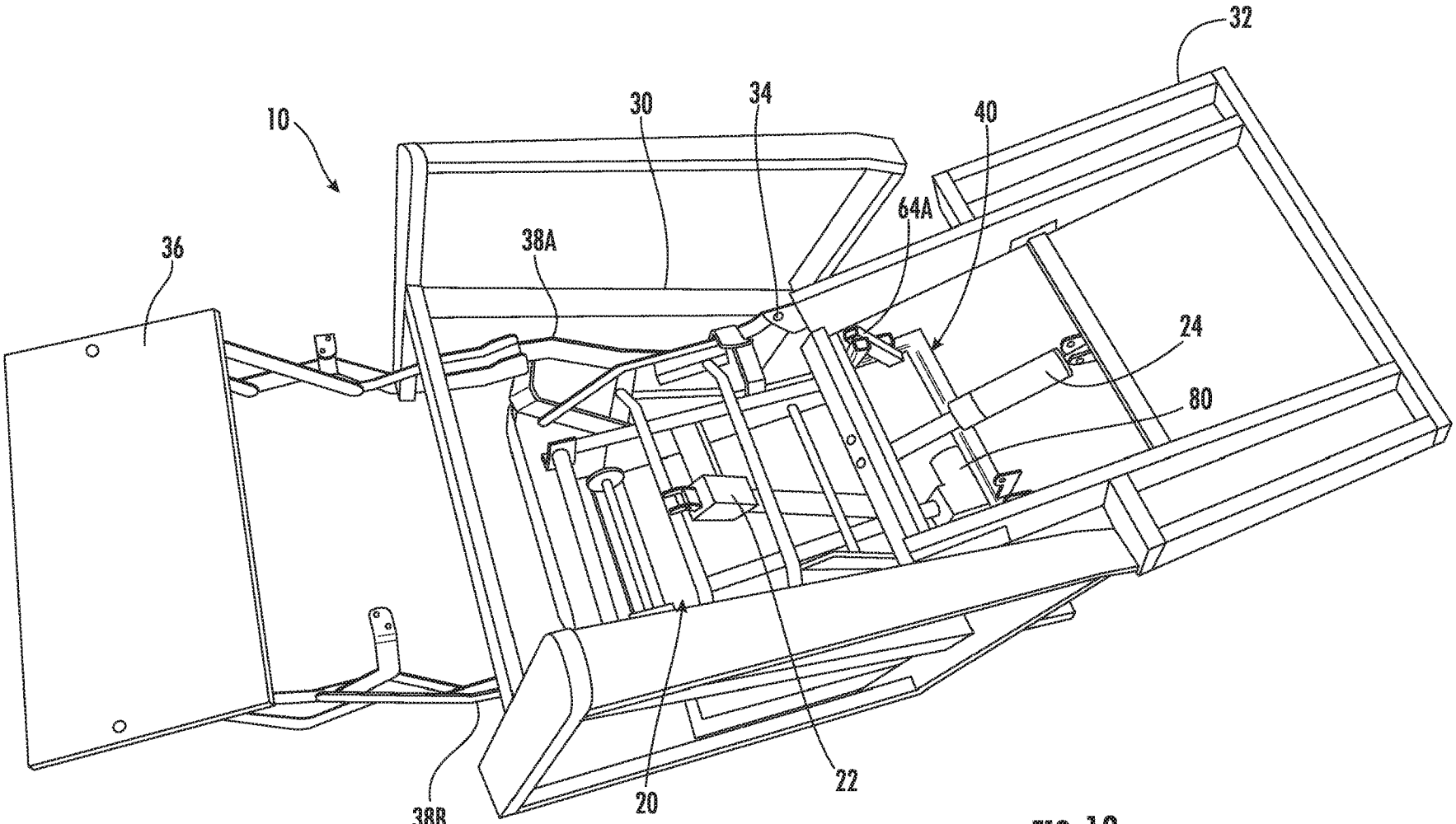
FIG. 18 is a top view of the lift and recliner chair of FIG. 1 in the recline position.
Figure 19:
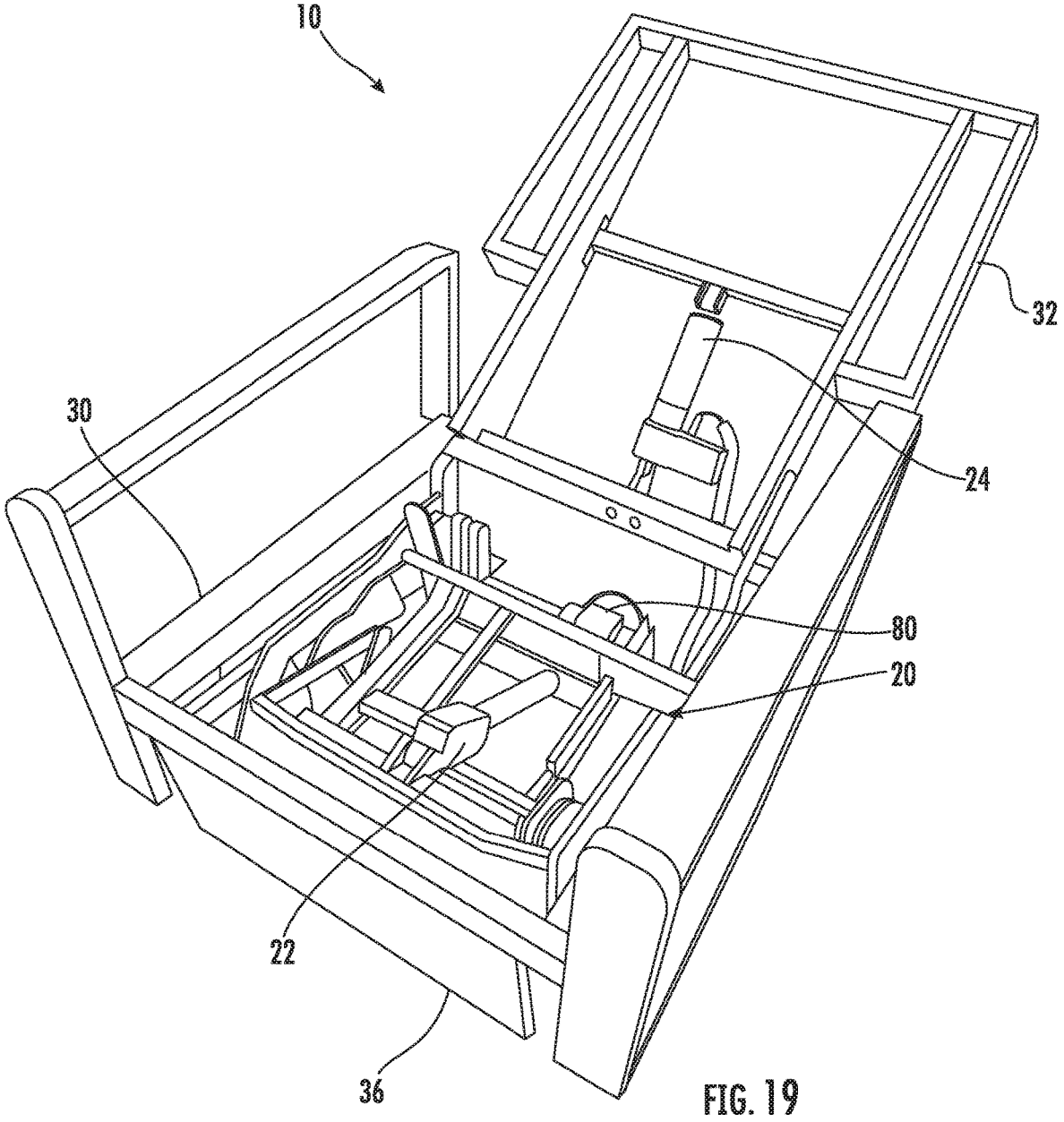
FIG. 19 is a front perspective view of the lift and recliner chair of FIG. 1 in a standard seating position with only the back being actuated to a reclined position.

In another preferred aspect, a control device 92 is connected to the controller 90. The controller memory, shown in FIG. 32, is configured to store pre-set actuator positions for the at least one lift-recline actuator 22, 24 and the cradle actuator 80 that are activatable via the control device 92. The control device 92 preferably includes buttons 94 that are directional buttons for lift and recline movements as well as possibly backrest incline control. The control device 92 preferably further includes control buttons 96 for pre-set chair positions. These pre-set positions can be programmed into the controller memory, either in the factory or by a user, for example by pressing and holding a button 96 for a predetermined time period to "set" a favorite position in the memory, and then pressing the button 96 to recall the position. The controller 90 is preferably configured to provide a fully reclined and cradle position, as shown in FIG. 16 in which the at least one lift-recline actuator 22, 24 is in a fully reclined position and the cradle actuator 80 is in a forward-most extended position.

The lift and recliner chair 10 preferably includes an extendable foot rest 36 connected to the lift and recline mechanism 20. Preferably, this is connected to two pantograph linkages, 38A, 38B connected between the seat 30 and the foot rest 36. These are shown in detail in FIGS. 17 and 18. While the pantograph linkages 38A, 38B are preferred, other mechanisms could be utilized, if desired.

Figure 20:
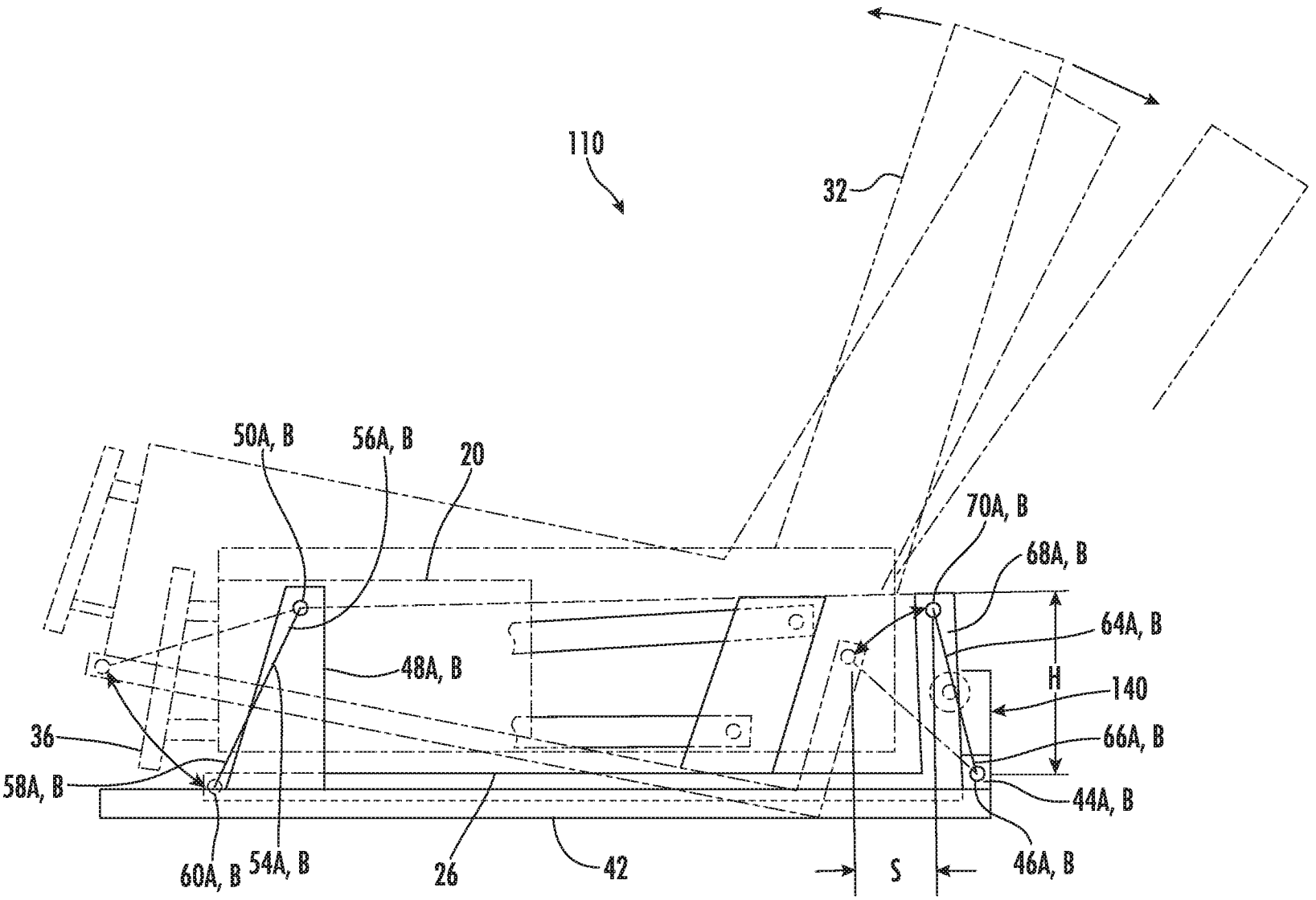
FIG. 20 is a schematic side elevational view of a lift and recliner chair in accordance with a second embodiment, shown in a neutral or start position of the cradle assembly and including a phantom line representation of the cradle assembly in the extended position.
Figure 21:
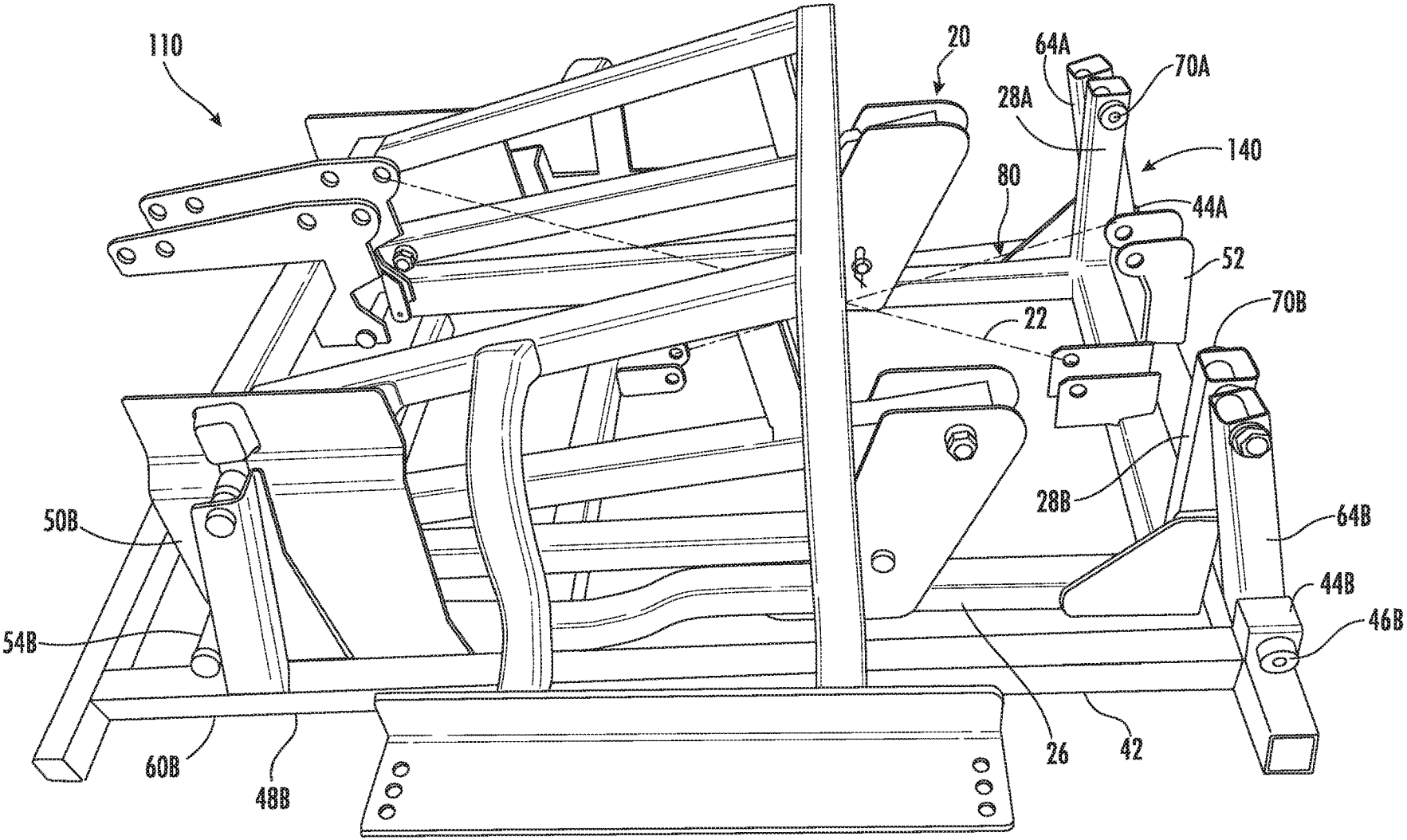
FIG. 21 is a left side perspective view of the cradle assembly for the lift and recliner chair of FIG. 20 shown in the neutral or start position of the cradle assembly. The cradle actuator and lift-recline mechanism actuator are only represented by a center line.
Figure 22:
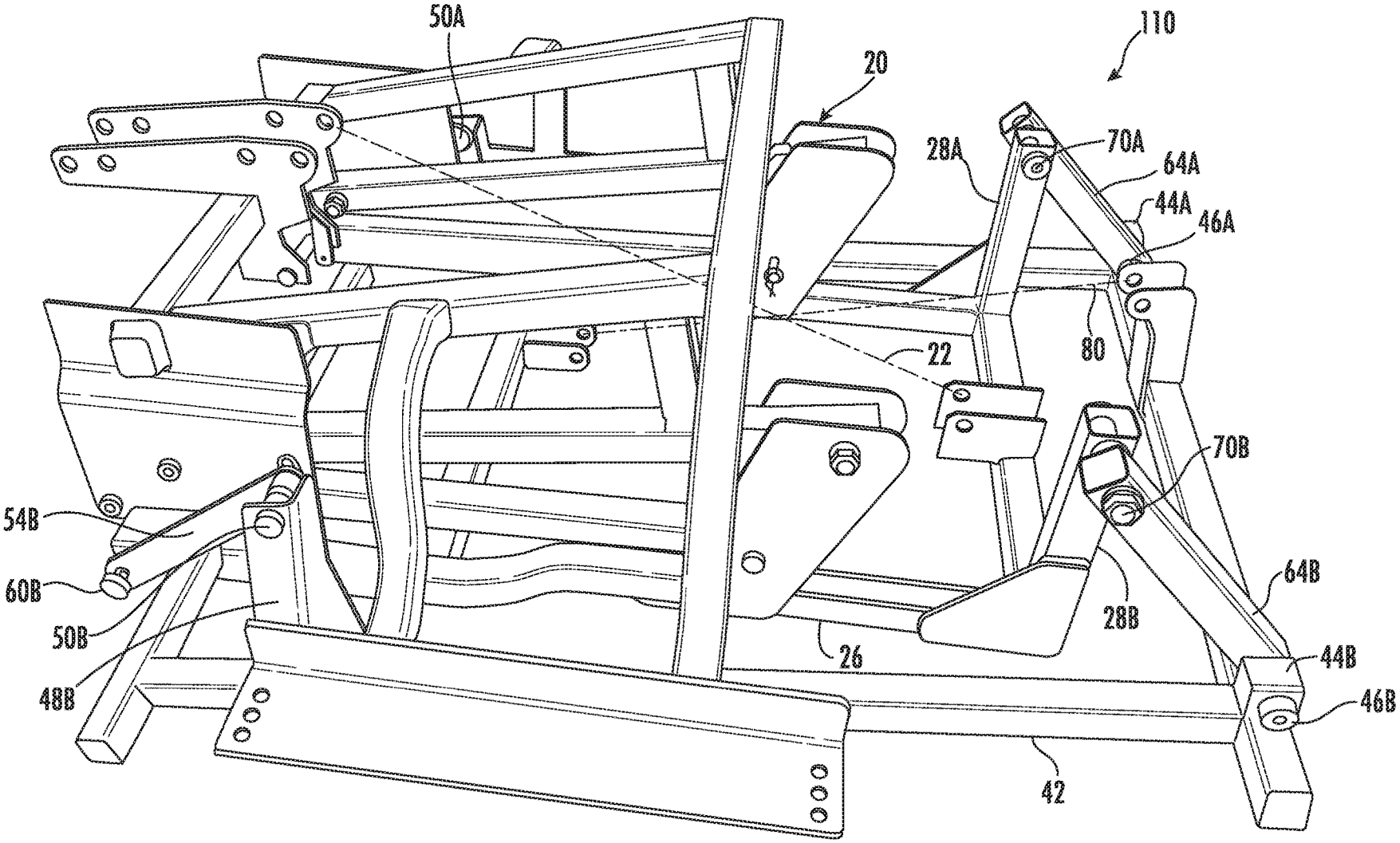
FIG. 22 is a left side perspective view of the cradle assembly for the lift and recliner chair of FIG. 20 shown in the extended position of the cradle assembly. The cradle actuator and lift-recline mechanism actuator are only represented by a center line.
Figure 23:
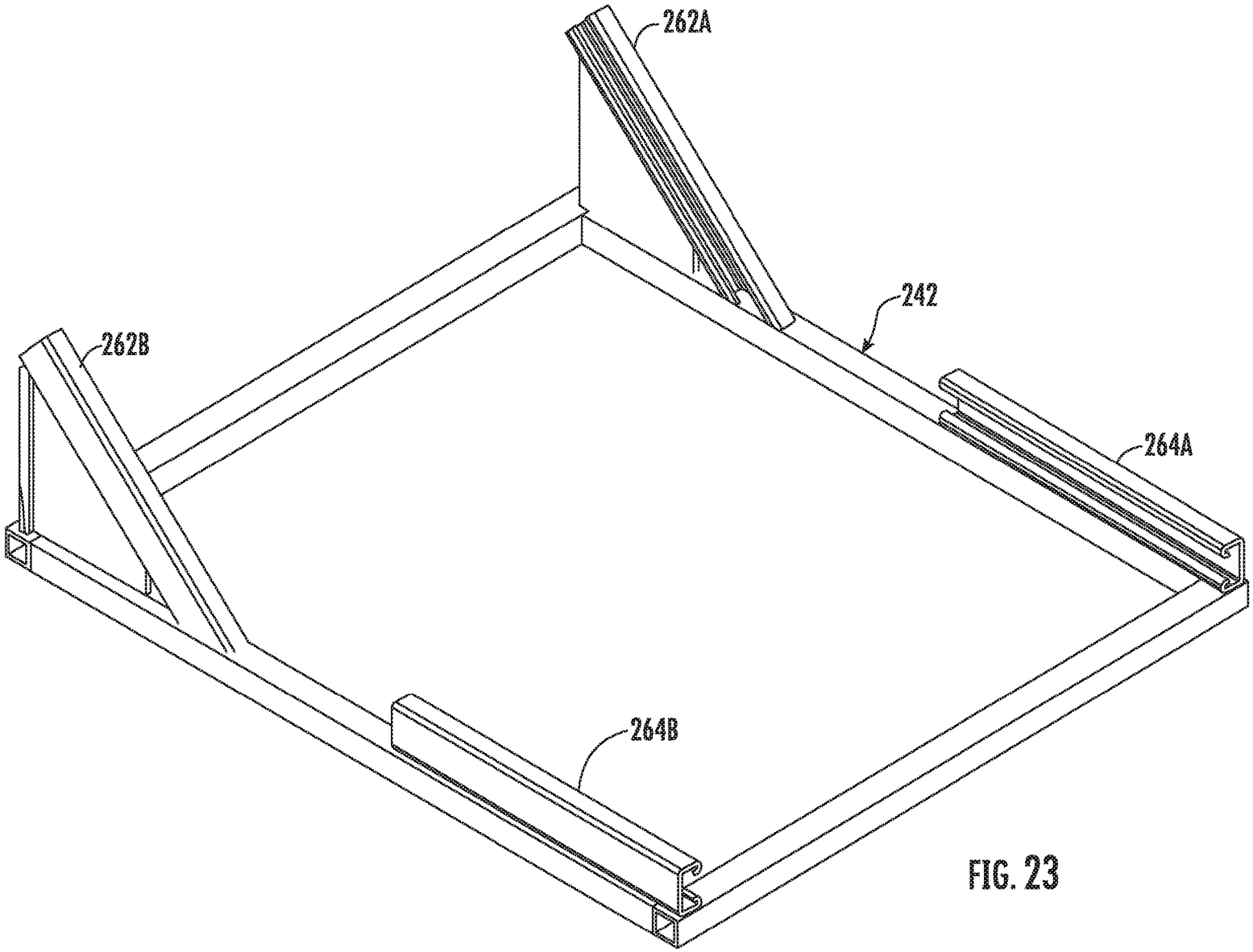
FIG. 23 is a perspective view of a cradle base for a third embodiment of a lift and recliner chair in accordance with the invention.

FIGS. 20-22 show a second embodiment of a lift and recliner chair 110. The lift and recliner chair 110 is similar to the lift and recliner chair 10, and like element numbers have been used to designate the same parts. The primary difference in the lift and recliner chair 110 is in that the cradle assembly 140 includes the rear standoffs 44A, 44B located along the back part of the cradle base 42, such that in the neutral position with the cradle actuator 80 retracted, the rear links 64A, 64B have the second ends 68A, 68B tilted forward to connect to the rear pivot axes 70A, 70B, and the front links 54A, 54B are also tilted forward from the first ends 56A, 56B to the second ends 58A, 58B, preferably by about 15° to 30°. In a preferred arrangement, the front pivot connections 60A, 60B to the lift-recline base 26 are arranged approximately 3 inches forward of the front pivot axes 50A, 50B, and the front standoffs 44A, 44B and the rear standoffs 48A, 48B (at the respective pivot axis locations) is about 20-22 inches. By having the front links 54A, 54B arranged in this manner, the majority of the cradle movement is an upward movement at the front of the lift-recline base 26 and a combined forward and downward movement at the back of the lift-recline base 26. The extended position of lift-recline base 26 for the cradle actuator 80 being actuated (extended) is shown in phantom lines in FIG. 20 with the distance of forward travel E being indicated as well.

The specific movement provided by the cradle assembly 140 can be tailored for specific requirements by adjusting the spacing and neutral angle positions of the front and rear links 54A, 54B; 64A, 64B, the spacing and height difference between the front pivot axes 50A, 50B and the rear pivot axes 46A, 46B, and the spacing and the height difference between the front pivot connections 60A, 60B; 70A, 70B.

While the preferred embodiments of the cradle assembly 40, 140 includes the front and rear links, the functionality for the cradle movement can be provided with a cradle mechanism 240 using a track and roller or slide system having the desired configuration as shown in the third embodiment of a lift and recliner chair 210 as shown in FIGS. 23-27.

As shown in FIGS. 23-27, the cradle function is provided by slides or rollers (shown as rollers 252A, 252B; 254A, 254B) located on one of the cradle base 242 or the lift-recline base 226 (shown here on the lift-recline base 226) that interact with guide tracks 262A, 262B; 264A, 264B on the other of the lift-recline base 226 or the cradle base 242 (shown here on the cradle base 242) in order to provide a similar cradling movement when the cradle actuator is actuated to move the lift-recline base forward relative to the cradle base. The guide tracks 262A, 262B; 264A, 264B are preferably linear, but could be curved. The guide tracks 262A, 262B; 264A, 264B preferably have a generally C-shaped cross-section. Preferably, the front guide tracks 262A, 262B are angled upwardly as they extend toward the front of the chair 210 by an angle of about 30° to 60°, and more preferably of between 35° and 45°. The rear guide tracks 264A, 264B are preferably horizontal. The guide tracks 262A, 262B; 264A, 264B are preferably permanently attached to the cradle base 242, preferably by welding. While rollers 252A, 252B; 254A, 254B are shown, these could be replaced with solid material slides that are adapted to an interior shape of the guide tracks 262A, 262B; 264A, 264B. The slides could be made of a polymeric material or a metal base coated with a polymeric material, such as nylon.

Figure 24:
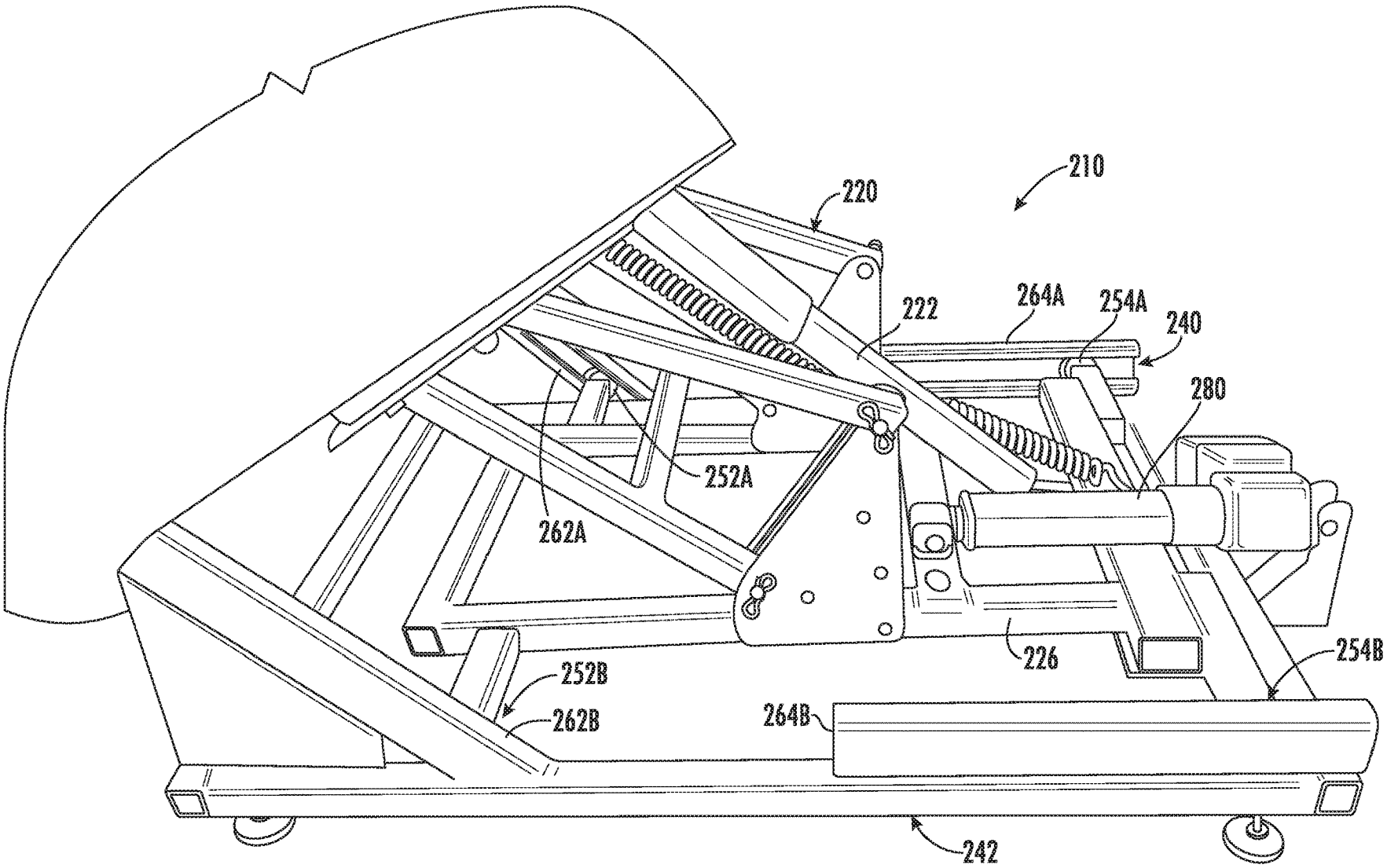
FIG. 24 is a left side perspective view of the cradle assembly for a lift and recliner chair using the cradle base shown in FIG. 23 shown in the neutral or start position of the cradle assembly.
Figure 25:
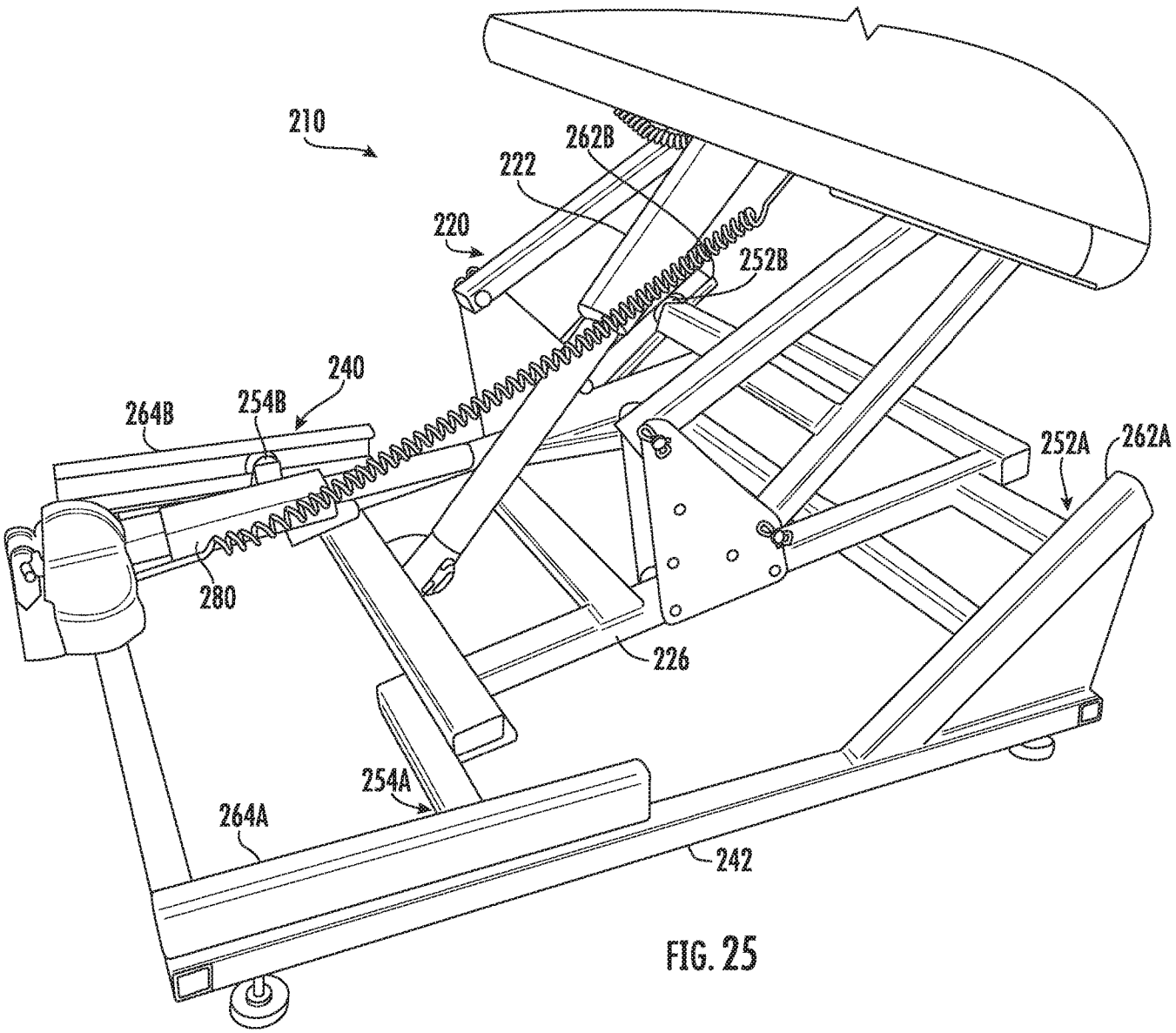
FIG. 25 is a right side perspective view of the cradle assembly for a lift and recliner chair shown in FIG. 24 shown in an extended position of the cradle assembly.
Figure 26:
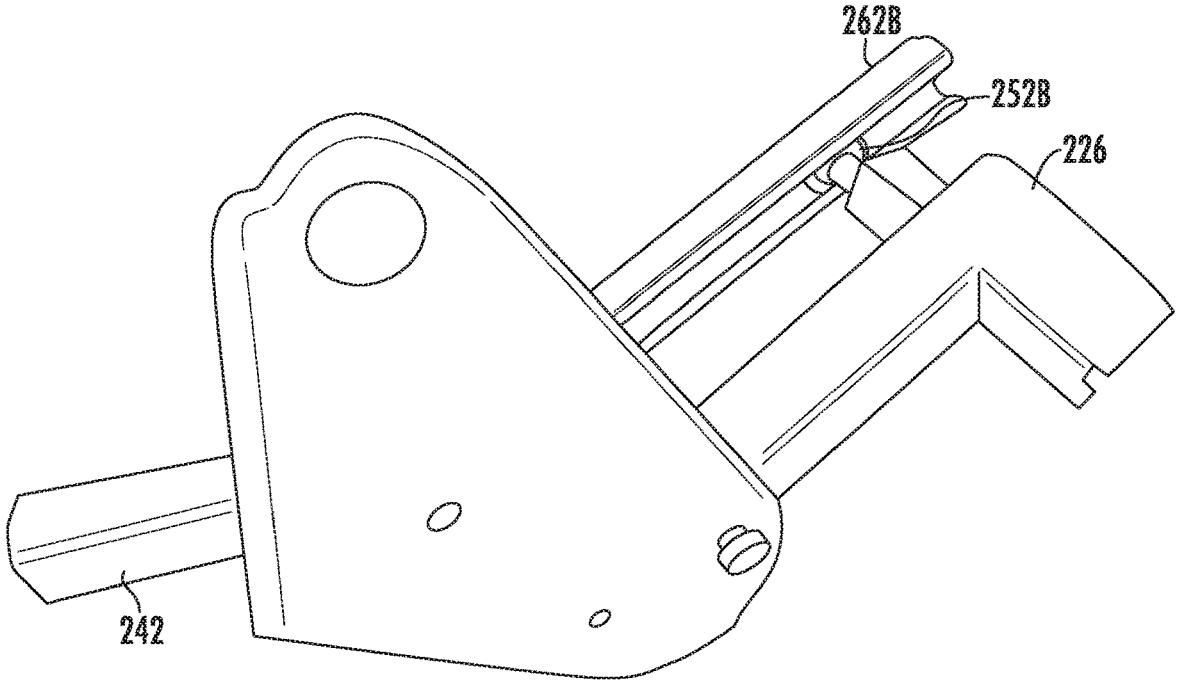
FIG. 26 is an enlarged perspective view of a portion of FIG. 25 showing a guide wheel on a front of the lift-recline base traveling in an upwardly angled guide track located at the front of the cradle base.
Figure 27:
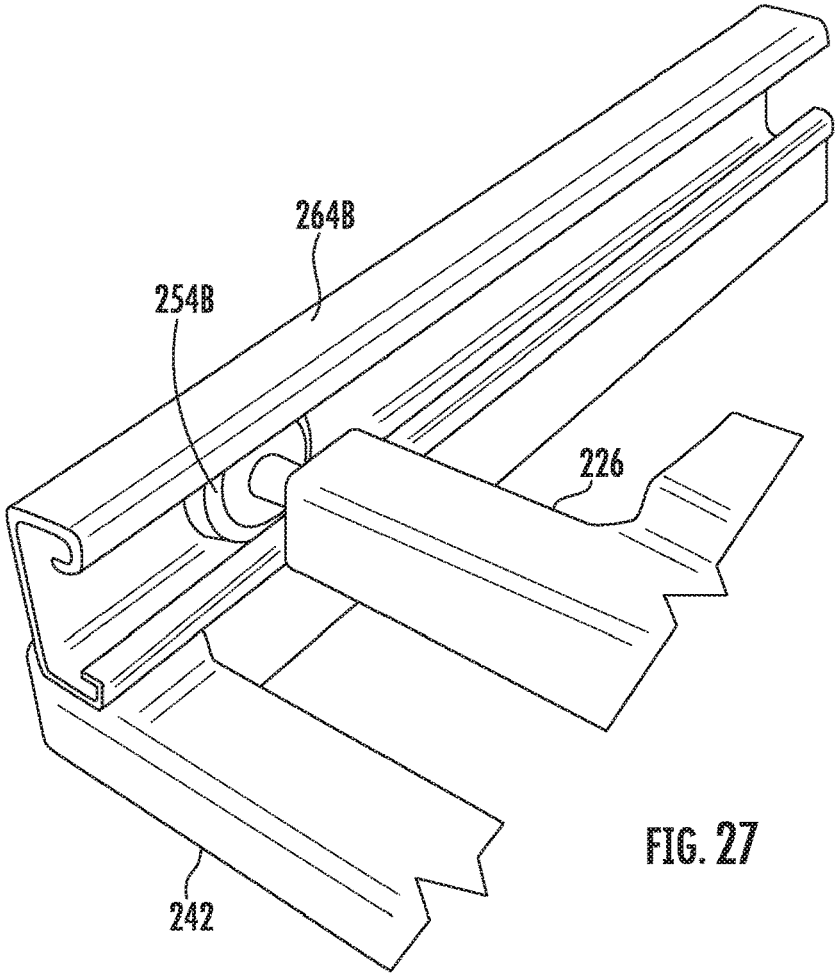
FIG. 27 is an enlarged perspective view of a portion of FIG. 25 showing a guide wheel on a back of the lift-recline base traveling in a horizontal guide track located at the rear of the cradle base.

As shown on FIGS. 24 and 25, the cradle actuator 280 can move the lift—recline base 226 between a neutral position, shown in FIG. 24, and an extended, cradle position, shown in FIG. 25, and this motion is translated to the lift-recline base 226 which supports a separate lift and recline chair mechanism 220, that can include a lift-recline actuator 222 as well as optionally a separate backrest actuator (not shown). This provides the same functionality for the chair as the prior embodiments 10, 110 without the need for the pivoting link connections. Further, the exact cradle path can be customized based on the path of the guide tracks 262A, 262B; 264A, 264B.

Figure 33:
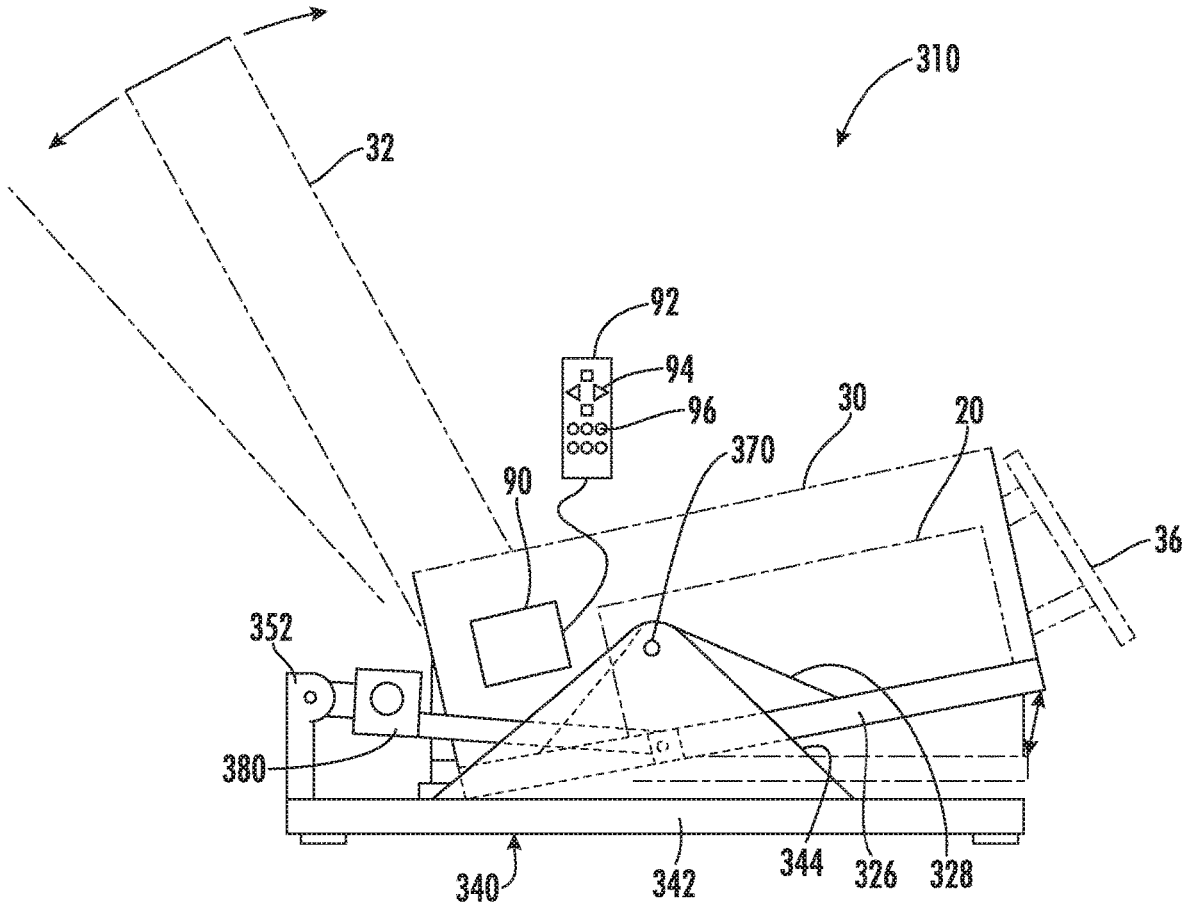
FIG. 33 is a schematic side elevational view of a lift and recliner chair in accordance with a third embodiment, shown in the extended position of the cradle assembly and including a phantom line representation of the cradle assembly in the a neutral or start position.

FIG. 33 shows a fourth embodiment of a lift and recliner chair 310. The lift and recliner chair 310 is similar to the lift and recliner chair 10, and like element numbers have been used to designate the same parts. The primary difference in the lift and recliner chair 310 is in that the cradle assembly 340 includes a cradle base 342 having generally centrally located standoffs 344 on each side, and the lift-recline base 326 also includes generally centrally located uprights 328 on each side, which are connected along aligned pivot axes 370.

The chair 310 includes the seat 30 and the back 32 connected to the lift and recline chair mechanism 20, and the lift and recline chair mechanism 20 includes the lift-recline base 326 which forms a part of the lift and recline chair mechanism 20. In this embodiment, the cradle base 342 is also preferably formed of welded tubular steel and the standoffs 344 are connected to the cradle base 342 and include the aligned pivot axes 370, with pivot connections preferably formed via pins that extend through holes in the standoffs 344 and the uprights 328 at the pivot axes 370.

An actuator mount 352 is connected to the cradle base 342, preferably along the rear portion thereof. This can be formed by a pair of plates that are spaced apart in order to allow pivotable mounting of the cradle actuator 380. The opposite end of the cradle actuator 380 is preferably connected to a medial cross piece that extends between the two sides of the lift-recline base 326, The cradle actuator 380 is actuated via the controller 90 to move the lift-recline base 326 in an arcuate path about the pivot axes 370 to move the lift-recline base 326 forward and upward in a cradle motion from its initial neutral position to an extended, cradle position. This arrangement provides for the same superposed types of motion in combination with lift and recline chair mechanism 20 as the prior embodiments of the lift and recliner chair 10, 110, 210. Adjusting the height and front-to-back location of the pivot axes 370 can be used to achieve different cradle motion paths.

Figure 34:
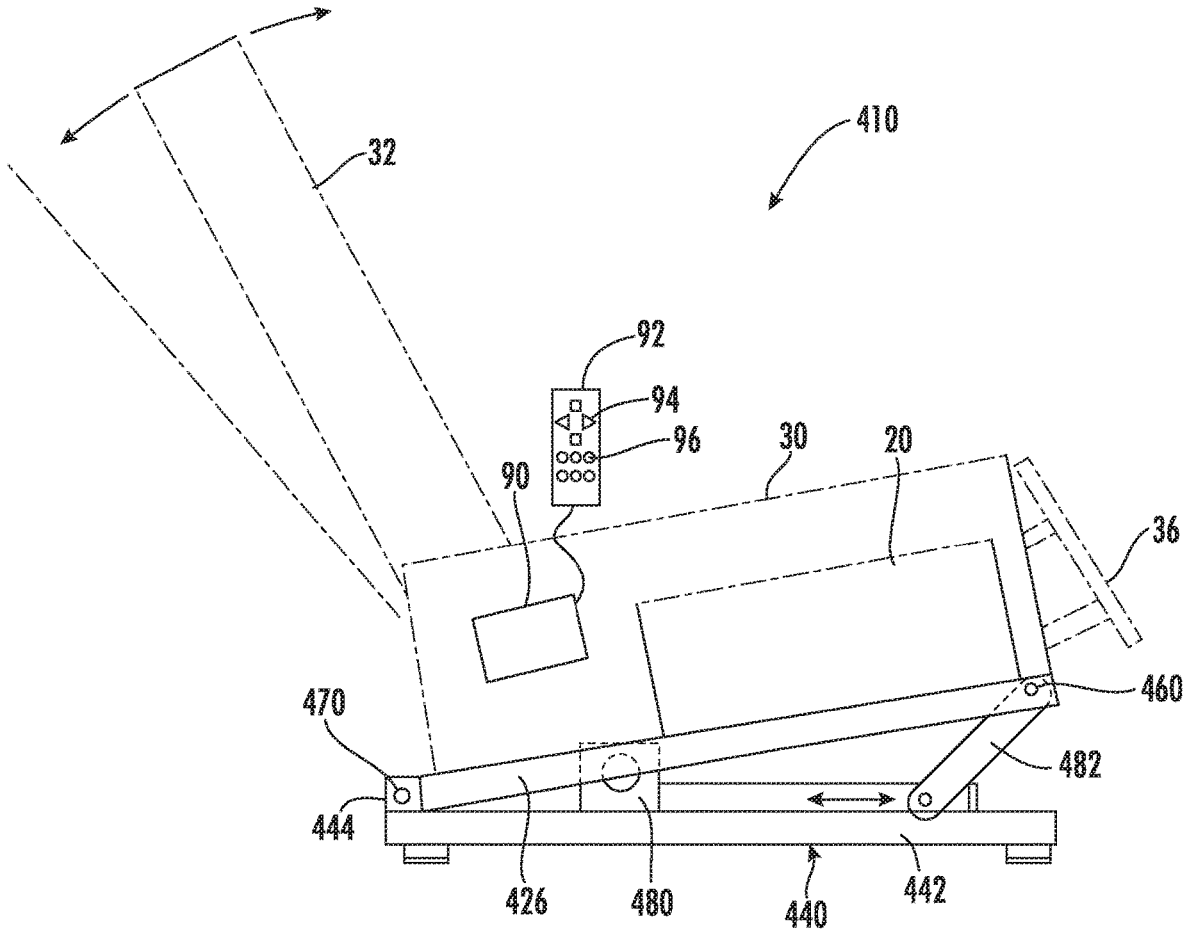
FIG. 34 is a schematic side elevational view of a lift and recliner chair in accordance with a fourth embodiment, shown in the extended position of the cradle assembly and including a phantom line representation of the cradle assembly in the a neutral or start position.

FIG. 34 shows a fifth embodiment of a lift and recliner chair 410. The lift and recliner chair 410 is similar to the lift and recliner chair 310, and like element numbers have been used to designate the same parts. The primary difference in the lift and recliner chair 410 is in that the cradle assembly 440 includes a cradle base 442 having rear standoffs 444 on each side, and the lift-recline base 426 is connected along aligned pivot axes 470 to the rear standoffs 444.

The chair 410 includes the seat 30 and the back 32 connected to the lift and recline chair mechanism 20, and the lift and recline chair mechanism 20 includes the lift-recline base 426 which forms a part of the lift and recline chair mechanism 20. In this embodiment, the cradle base 442 is also preferably formed of welded tubular steel and the rear standoffs 444 are connected to the cradle base 442 and include the aligned pivot axes 470, with pivot connections preferably formed via pins that extend through holes in the standoffs 444 and the lift-recline base 426 at the pivot axes 470.

The cradle actuator 480 is connected to the cradle base 442, and is preferably constrained to a linear horizontal actuation drive motion. The opposite end of the cradle actuator 480 is preferably connected pivotally to a drive link 482 that extends to a pivot point 460 on the lift-recline base 426, preferably near the front thereof. The cradle actuator 480 is actuated via the controller 90 to move the lift-recline base 426 in an arcuate path about the pivot axes 470 to move the lift-recline base 326 upward at the front in a cradle motion from its initial neutral position to an extended, cradle position, as shown. This arrangement provides for the same superposed types of motion in combination with lift and recline chair mechanism 20 as the prior embodiments of the lift and recliner chair 10, 110, 210, 310.

Those skilled in the art will recognize that the pivotal connections referred to in the above embodiments can be formed by bolts or pins, with or without bushings to prevent wear, or any other type of suitable pivotable connection.

In all of the embodiments, the lift and recline chair mechanism 20 could just be a recline mechanism of the type known to those of ordinary skill in the art and have a recline base instead of a lift-recline base. This would provide recliner chairs with the additional advantages of the cradle assembly movements.

While the preferred embodiments of the invention has been described in detail, those skilled in the art will recognize that other changes could be made to the lift and recliner chair 10, 110, 210, 310, 410 without departing from the scope of the present invention. Other types of coupling arrangements could be provided and the specific configuration could be varied without departing from the scope of the present invention. Accordingly, the scope of the invention should not be limited by the preferred embodiments discussed above and instead should be defined by the description of the embodiments as well as the claims below.

LIST OF EMBODIMENTS

Embodiment 1

A lift and recliner chair, comprising: a lift and recline chair mechanism having at least one lift-recline actuator that controls a lifting movement and a reclining movement, the lift and recline chair mechanism having a lift-recline base; a seat and a back connected to the lift and recline chair mechanism, with the back being effectively pivotable relative to the seat; a cradle assembly, including: a cradle base; rear standoffs on the cradle base with aligned rear pivot axes; front standoffs on the cradle base with aligned front pivot axes, wherein the front pivot axes are located at a distance above the rear pivot axes; an actuator mount connected to the cradle base; front links having first ends pivotably connected to respective ones of the front standoffs at the front pivot axes and second ends pivotably connected to respective ones of front pivot connections on the lift-recline base; rear links having first ends pivotably connected to respective ones of the rear standoffs at the rear pivot axes and second ends pivotably connected to respective ones of rear pivot connections on the lift-recline base; a cradle actuator connected between the actuator mount and the lift-recline base; and a controller that controls movement of the cradle actuator and the at least one the lift-recline actuator.

Embodiment 2

The lift and recliner chair of Embodiment 1, wherein the controller is configured to actuate the cradle actuator to move the lift-recline base forward as the at least one lift-recline actuator is actuated to recline the back to at least partially offset an extension distance of the back from the cradle base.

Embodiment 3

The lift and recliner chair of Embodiments 1 or 2, wherein the front pivot axes are located at least about four inches above the rear pivot axes.

Embodiment 4

The lift and recliner chair of any of Embodiments 1 to 3, wherein the lift-recline base includes rear uprights and the rear pivot connections are located on the rear uprights.

Embodiment 5

The lift and recliner chair of any one of Embodiments 1 to 4, wherein the rear pivot connections on the rear uprights are located at least about four inches above the front pivot connections in a non-actuated position of the cradle actuator.

Embodiment 6

The lift and recliner chair of any one of Embodiments 1 to 5, wherein the controller is further configured to actuate the cradle actuator to move the lift-recline base forward as the at least one lift-recline actuator is actuated to raise the seat to increase a vertical lift position of the seat.

Embodiment 7

The lift and recliner chair of any one of Embodiments 1 to 6, wherein the vertical lift position of the seat is at least two inches greater with the cradle actuator actuated and the lift-recline base moved forward than a maximum lift with the cradle actuator in a non-actuated position.

Embodiment 8

The lift and recliner chair of any one of Embodiments 1 to 7, wherein the at least one lift-recline actuator includes a separate lift-recline actuator and a backrest actuator, and the controller is configured to (a) actuate the cradle actuator to move the lift-recline base forward to at least partially offset an extension distance of the back from the cradle base as the backrest actuator is actuated to recline the back, and (b) actuate the cradle actuator to move the lift-recline base backward as the backrest actuator is actuated to raise the back.

Embodiment 9

The lift and recliner chair of any one of Embodiments 1 to 8, wherein the controller comprises a processor and a controller memory, a control device is connected to the controller, and the controller memory is configured to store pre-set actuator positions for the at least one lift-recline actuator and the cradle actuator that are activatable via the control device.

Embodiment 10

The lift and recliner chair of any one of Embodiments 1 to 9, wherein the controller is configured to provide a fully reclined and cradle position in which the at least one lift-recline actuator is in a fully reclined position and the cradle actuator is in a forward-most extended position.

Embodiment 11

The lift and recliner chair of any one of Embodiments 1 to 10, wherein the at least one lift-recline actuator and the cradle actuator are electric motor driven actuators.

Embodiment 12

The lift and recliner chair of any one of Embodiments 1 to 11, further comprising an extendable footrest connected to the lift and recline mechanism.

Embodiment 13

The lift and recliner chair of any one of Embodiments 1 to 12, wherein lift and recline mechanism includes two pantograph linkages connected between the seat and the footrest.

Embodiment 14

A recliner chair, comprising: a recline chair mechanism providing a reclining movement, the recline chair mechanism having a recline base; a seat and a back connected to the recline chair mechanism, with the back being effectively connected relative to the seat; a cradle assembly, including: a cradle base;

rear standoffs on the cradle base with aligned rear pivot axes; rear links having first ends pivotably connected to respective ones of the rear standoffs at the rear pivot axes and second ends pivotably connected to respective ones of rear pivot connections on the recline base; front standoffs on the cradle base with aligned front pivot axes; front links having first ends pivotably connected to respective ones of the front standoffs at the front pivot axes and second ends pivotably connected to respective ones of front pivot connections on the recline base; an actuator mount connected to the cradle base; a cradle actuator connected between the actuator mount on the cradle base and the recline base; and a controller that controls movement of the cradle actuator.

Embodiment 15

The recliner chair of Embodiment 14, wherein the controller is configured to actuate the cradle actuator to move the recline base forward to at least partially offset an extension distance of the back from the cradle base to provide enhanced wall clearance.

Embodiment 16

A lift and recliner chair, comprising: a lift and recline chair mechanism having at least one lift-recline actuator that controls a lifting movement and a reclining movement, the lift and recline chair mechanism having a lift-recline base; a seat and a back connected to the lift and recline chair mechanism, with the back being effectively connected relative to the seat; a cradle assembly, including: a cradle base; a track and roller or slide system configured to provide a forward movement of the lift-recline base and an upward tilt, the track and roller or slide system including: slides or rollers located on one of the cradle base or the lift-recline base that interact with guide tracks on the other of the lift-recline base or the cradle base; an actuator mount connected to the cradle base; a cradle actuator connected between the actuator mount on the cradle base and the lift-recline base; and a controller that controls movement of the cradle actuator, the controller is configured to actuate the cradle actuator to move the lift-recline base forward and the front of the lift-recline base upward via the slides or rollers moving along respective ones of the guide tracks.

Embodiment 17

The lift and recliner chair of Embodiment 16, wherein the rollers are used and are connected to the lift-recline base in forward and back pairs, and forward and back aligned pairs of guide tracks are located on the cradle base that receive respective ones of the rollers.

Embodiment 18

The lift and recliner chair of Embodiments 16 or 17, wherein the forward aligned pair of guide tracks is angled upwardly as they extend forward by an angle of about 30° to 60°.

Embodiment 19

The lift and recliner chair of any one of Embodiments 16 to 18, wherein the forward aligned pair of guide tracks extend along a straight path.

Embodiment 20

A recliner chair, comprising: a recline chair mechanism having a reclining movement, the recline chair mechanism having a recline base; a seat and a back connected to the recline chair mechanism, with the back being effectively connected relative to the seat; a cradle assembly, including: a cradle base; a track and roller or slide system configured to provide a forward movement of the lift-recline base and an upward tilt, the track and roller or slide system including: slides or rollers located on one of the cradle base or the recline base that interact with guide tracks on the other of the recline base or the cradle base; an actuator mount connected to the cradle base; a cradle actuator connected between the actuator mount on the cradle base and the recline base; and a controller that controls movement of the cradle actuator.

Embodiment 21

The lift and recliner chair of Embodiment 20, wherein the controller is configured to actuate the cradle actuator to move the lift-recline base forward as the at least one lift-recline actuator is actuated to recline the back to at least partially offset an extension distance of the back from the cradle base to provide enhanced wall clearance.

Embodiment 22

A recliner chair, comprising: a recline chair mechanism providing a reclining movement, the recline chair mechanism having a recline base; a seat and a back connected to the recline chair mechanism, with the back being effectively connected relative to the seat; a cradle assembly, including: a cradle base; standoffs on the cradle base with aligned pivot axes; the recline base being pivotably connected to the standoffs at the aligned pivot axes; an actuator mount connected to the cradle base; a cradle actuator connected between the actuator mount on the cradle base and the recline base; and a controller that controls movement of the cradle actuator.

Embodiment 23

The recliner chair of Embodiment 22, wherein the standoffs on the cradle base are generally centrally located, and the recline base also includes generally centrally located uprights on each side, and the recline base is connected to the standoffs at the uprights via pins extending along the pivot axes.

Embodiment 24

The recliner chair of Embodiments 22 or 23, wherein the recline chair mechanism incudes a recline actuator, and the controller is configured to actuate the cradle actuator to move the recline base forward as the recline actuator is actuated to recline the back to at least partially offset an extension distance of the back from the cradle base.

Embodiment 25

The recliner chair of any one of Embodiments 22 to 24, wherein the standoffs on the cradle base are rear standoffs, and the recline base is connected to the rear standoffs via pins extending along the pivot axes.

Embodiment 26

The recliner chair of any one of Embodiments 22 to 25, wherein the controller comprises a processor and a controller memory, a control device is connected to the controller, and the controller memory is configured to store pre-set actuator positions for at least one recline actuator of the recline chair mechanism, and the cradle actuator that are activatable via the control device.

Embodiment 27

The recliner chair of any one of Embodiments 22 to 26, wherein the controller is configured to provide a fully reclined and cradle position in which at least one recline actuator is in a fully reclined position and the cradle actuator is in a forward-most extended position.

Embodiment 28

A lift and recliner chair, comprising: a lift and recline chair mechanism having at least one lift-recline actuator that controls a lifting movement and a reclining movement, the lift and recline chair mechanism having a lift-recline base; a seat and a back connected to the recline chair mechanism, with the back being effectively connected relative to the seat; a cradle assembly, including: a cradle base; standoffs on the cradle base with aligned pivot axes; the lift-recline base being pivotably connected to the standoffs at the aligned pivot axes; an actuator mount connected to the cradle base; a cradle actuator connected between the actuator mount on the cradle base and the lift-recline base; and a controller that controls movement of the cradle actuator.

Embodiment 29

The lift and recliner chair of Embodiment 28, wherein the standoffs on the cradle base are generally centrally located, and the lift-recline base also includes generally centrally located uprights on each side, and the lift-recline base is connected to the standoffs at the uprights via pins extending along the pivot axes.

Embodiment 30

The lift and recliner chair of any one of Embodiments 28 or 29, wherein the controller is configured to actuate the cradle actuator to move the lift-recline base forward as the at least one lift-recline actuator is actuated to recline the back to at least partially offset an extension distance of the back from the cradle base.

Embodiment 31

The recliner chair of any one of Embodiments 28 to 30, wherein the standoffs on the cradle base are rear standoffs, and the lift-recline base is connected to the rear standoffs via pins extending along the pivot axes.

Embodiment 32

The lift and recliner chair of any one of Embodiments 28 to 31, wherein the controller comprises a processor and a controller memory, a control device is connected to the controller, and the controller memory is configured to store pre-set actuator positions for the at least one lift-recline actuator and the cradle actuator that are activatable via the control device.

Embodiment 33

The lift and recliner chair of any one of Embodiments 28 to 32, wherein the controller is configured to provide a fully reclined and cradle position in which at least one loft-recline actuator is in a fully reclined position and the cradle actuator is in a forward-most extended position.

What is claimed is:

1. A lift and recliner chair, comprising:

a lift and recline chair mechanism having at least one lift-recline actuator that controls a lifting movement and a reclining movement, the lift and recline chair mechanism having a lift-recline base;

a seat and a back connected to the lift and recline chair mechanism;

a cradle assembly, including:

a cradle base;

rear pivot axes on the cradle base;

front pivot axes on the cradle base located at a distance above the rear pivot axes;

front links having first ends pivotably connected to respective ones of the front pivot axes and second ends pivotably connected to respective ones of front pivot connections on the lift-recline base;

rear links having first ends pivotably connected to respective ones of the rear pivot axes and second ends pivotably connected to respective ones of rear pivot connections on the lift-recline base;

a cradle actuator connected between the cradle base and the lift-recline base;

the front pivot connections being located below the front pivot axes in a non-actuated position of the cradle actuator, and the rear pivot connections being located above the rear pivot axes in a non-actuated position of the cradle actuator such that upon actuation of the cradle actuator a front of the seat moves forward and up in a cradling motion; and a controller that controls movement of the cradle actuator and the at least one the lift-recline actuator.

2. The lift and recliner chair of claim 1, wherein the controller is configured to actuate the cradle actuator to move the lift-recline base forward as the at least one lift-recline actuator is actuated to recline the back to at least partially offset an extension distance of the back from the cradle base.

3. The lift and recliner chair of claim 1, wherein the controller is further configured to actuate the cradle actuator to move the lift-recline base forward as the at least one lift-recline actuator is actuated to raise the seat to increase a vertical lift position of the seat.

4. The lift and recliner chair of claim 1, wherein the controller comprises a processor and a controller memory, a control device is connected to the controller, and the controller memory is configured to store pre-set actuator positions for the at least one lift-recline actuator and the cradle actuator that are activatable via the control device.

5. The lift and recliner chair of claim 1, wherein the at least one lift-recline actuator and the cradle actuator are electric motor driven actuators.

6. The lift and recliner chair of claim 1, further comprising an extendable footrest connected to the lift and recline chair mechanism.

7. A lift and recliner chair, comprising:

a lift and recline chair mechanism having at least one lift-recline actuator that controls a lifting movement and a reclining movement, the lift and recline chair mechanism having a lift-recline base;

a seat and a back connected to the lift and recline chair mechanism;

a cradle assembly, including:

a cradle base;

aligned rear pivot axes on the cradle base;

aligned front pivot axes on the cradle base;

front links having first ends pivotably connected to respective ones of the front pivot axes and second ends pivotably connected to respective ones of front pivot connections on the lift-recline base;

rear links having first ends pivotably connected to respective ones of the rear pivot axes and second ends pivotably connected to respective ones of rear pivot connections on the lift-recline base;

a cradle actuator connected between the cradle base and the lift-recline base;

the front links being arranged such that upon actuation of the cradle actuator the first ends of the front links are moved forward and upward relative to the lift-recline base while the front links pivot about the front pivot axes relative to the cradle base, and the rear links being arranged such that the first ends of the rear links are moved forward and downward relative to the lift-recline base while the rear links pivot about the rear pivot axes relative to the cradle such that a front of the seat moves forward and up in a cradling motion; and a controller that controls movement of the cradle actuator and the at least one the lift-recline actuator.

8. The lift and recliner chair of claim 7, wherein the controller is further configured to actuate the cradle actuator to move the lift-recline base forward as the at least one lift-recline actuator is actuated to raise the seat to increase a vertical lift position of the seat.

9. The lift and recliner chair of claim 7, wherein the controller comprises a processor and a controller memory, a control device is connected to the controller, and the controller memory is configured to store pre-set actuator positions for the at least one lift-recline actuator and the cradle actuator that are activatable via the control device.

10. The lift and recliner chair of claim 7, wherein the at least one lift-recline actuator and the cradle actuator are electric motor driven actuators.

11. The lift and recliner chair of claim 7, further comprising an extendable footrest connected to the lift and recline chair mechanism.

12. A lift and recliner chair, comprising:

a lift and recline chair mechanism having at least one lift-recline actuator that controls a lifting movement and a reclining movement, the lift and recline chair mechanism having a lift-recline base;

a seat and a back connected to the lift and recline chair mechanism;

a cradle assembly, including:

a cradle base;

rear pivot axes on the cradle base;

front pivot axes on the cradle base;

front links having first ends pivotably connected to respective ones of the front pivot axes and second ends pivotably connected to respective ones of front pivot connections on the lift-recline base;

rear links having first ends pivotably connected to respective ones of the rear pivot axes and second ends pivotably connected to respective ones of rear pivot connections on the lift-recline base;

a cradle actuator connected between the cradle base and the lift-recline base;

the front links being configured such that upon actuation of the cradle actuator, the first ends of the front links move forward and upward relative to the lift-recline base as the front links pivot about the front axes relative to the cradle base, and the rear links being configured such that upon actuation of the cradle actuator, the first ends of the rear links move forward and downward relative to the lift-recline base as the rear links pivot about the rear axes relative to the cradle base such that a front of the seat moves forward and up in a cradling motion; and a controller that controls movement of the cradle actuator and the at least one the lift-recline actuator.

13. The lift and recliner chair of claim 12, wherein the controller is further configured to actuate the cradle actuator to move the lift-recline base forward as the at least one lift-recline actuator is actuated to raise the seat to increase a vertical lift position of the seat.

14. The lift and recliner chair of claim 12, wherein the controller comprises a processor and a controller memory, a control device is connected to the controller, and the controller memory is configured to store pre-set actuator positions for the at least one lift-recline actuator and the cradle actuator that are activatable via the control device.

15. The lift and recliner chair of claim 12, wherein the at least one lift-recline actuator and the cradle actuator are electric motor driven actuators.

16. The lift and recliner chair of claim 12, further comprising an extendable footrest connected to the lift and recline chair mechanism.

17. A lift and recliner chair, comprising:

a lift and recline chair mechanism having at least one lift-recline actuator that controls a lifting movement and a reclining movement, the lift and recline chair mechanism having a lift-recline base;

a seat and a back connected to the lift and recline chair mechanism;

a cradle assembly, including:

a cradle base;

aligned first pivot axes on the cradle base;

aligned second pivot axes on the cradle base;

front links having first ends pivotably connected to respective ones of the first pivot axes and second ends pivotably connected to respective ones of front pivot connections on the lift-recline base;

rear links having first ends pivotably connected to respective ones of the second pivot axes and second ends pivotably connected to respective ones of rear pivot connections on the lift-recline base;

a cradle actuator connected between the cradle base and the lift-recline base;

the front pivot connections being located below the first pivot axes in a non-actuated position of the cradle actuator, and the rear pivot connections being located below the front pivot connections in a non-actuated position of the cradle actuator such that upon actuation of the cradle actuator a front of the seat moves forward and up in a cradling motion; and a controller that controls movement of the cradle actuator and the at least one the lift-recline actuator.

18. The lift and recliner chair of claim 17, wherein the controller is further configured to actuate the cradle actuator to move the lift-recline base forward as the at least one lift-recline actuator is actuated to raise the seat to increase a vertical lift position of the seat.

19. The lift and recliner chair of claim 17, wherein the controller comprises a processor and a controller memory, a control device is connected to the controller, and the controller memory is configured to store pre-set actuator positions for the at least one lift-recline actuator and the cradle actuator that are activatable via the control device.

20. The lift and recliner chair of claim 17, wherein the at least one lift-recline actuator and the cradle actuator are electric motor driven actuators.

21. The lift and recliner chair of claim 17, further comprising an extendable footrest connected to the lift and recline chair mechanism.

* * * * *